US009482507B2

(12) United States Patent
Thomson et al.

(10) Patent No.: US 9,482,507 B2
(45) Date of Patent: Nov. 1, 2016

(54) METHOD OF UNDERGROUND ROCK BLASTING

(71) Applicant: ORICA EXPLOSIVES TECHNOLOGY PTY LTD., Melbourne, Victoria (AU)

(72) Inventors: Stuart Patrick Thomson, Singapore (SG); Sean Michael Freeman, Leederville (AU)

(73) Assignee: ORICA EXPLOSIVES TECHNOLOGY PTY LTD, Melbourne, Victoria (AU)

( * ) Notice: Subject to any disclaimer, the term of this patent is extended or adjusted under 35 U.S.C. 154(b) by 0 days.

(21) Appl. No.: 14/757,560

(22) Filed: Dec. 24, 2015

(65) Prior Publication Data

US 2016/0146588 A1 May 26, 2016

Related U.S. Application Data

(63) Continuation of application No. 13/498,607, filed as application No. PCT/AU2010/001273 on Sep. 29, 2010, now Pat. No. 9,243,879.

(60) Provisional application No. 61/246,653, filed on Sep. 29, 2009.

(51) Int. Cl.
*F42D 3/04* (2006.01)
*E21C 37/14* (2006.01)
(Continued)

(52) U.S. Cl.
CPC ..... *F42D 3/04* (2013.01); *E21C 37/14* (2013.01); *F42B 3/10* (2013.01); *F42D 1/055* (2013.01)

(58) Field of Classification Search
CPC ..... F42D 3/04
USPC ..... 299/13; 102/311, 312, 318, 401, 217; 175/2, 4.54, 4.55
See application file for complete search history.

(56) References Cited

U.S. PATENT DOCUMENTS 4,216,998 A 8/1980 Bowen et al.
4,601,518 A 7/1986 Lanéus
(Continued)

FOREIGN PATENT DOCUMENTS

AU 768956 B2 1/2004
EP 0331399 A1 9/1989
(Continued)

OTHER PUBLICATIONS

Chilean Opposition Brief filed on Nov. 12, 2012 by Dyno Nobel, Inc., Solicitud No. 769-2012, 9 pages, along with a partial English translation.
(Continued)

*Primary Examiner* — Sunil Singh
(74) *Attorney, Agent, or Firm* — Birch, Stewart, Kolasch & Birch, LLP

(57) ABSTRACT

A method of blasting rock at an underground blast site in which boreholes (11*a, b, c*) are drilled in a rock mass 10 from a drive defining face 12, each borehole is loaded with at least one charge of explosive material (13*a-c,* 14*a-c,* 15*a-c*), at least one detonator is placed in operative association with each charge, and a sequence of at least two initiation events is conducted to blast the rock mass, in each of which only some of the charges are initiated, by sending firing signals to only the detonators associated with said charges and in which each initiation event is a discrete user-controlled initiation event. In one of the at least two initiation events a stranded portion of the rock mass such as a pillar is created that has already been drilled and charged, and the stranded portion of the rock mass is blasted in a subsequent one or more of the at least two initiation events without personnel accessing said stranded portion. First explosive charges (13*a, b, c* and 15*a, b, c*) may be blasted in the one initiation event, leaving a pillar of stranded ore with the preloaded borehole 11*b* extending through it. The detonators may be wireless.

24 Claims, 14 Drawing Sheets

(51) Int. Cl.

| | |
|---|---|
| ***F42D 1/055*** | (2006.01) |
| ***F42B 3/10*** | (2006.01) |

(56) References Cited

U.S. PATENT DOCUMENTS

| | | | |
|---|---|---|---|
| 6,454,359 | B1 | 9/2002 | Kang |
| 6,460,462 | B1 | 10/2002 | Rosenstock |
| 7,911,760 | B2 | 3/2011 | Lownds |
| 2005/0030695 | A1 | 2/2005 | Meyer et al. |
| 2007/0272110 | A1 | 11/2007 | Brent et al. |
| 2008/0134923 | A1 | 6/2008 | Lownds |
| 2010/0005994 | A1 | 1/2010 | Jacobson et al. |
| 2010/0212527 | A1 | 8/2010 | McCaan et al. |

FOREIGN PATENT DOCUMENTS

| | | | |
|---|---|---|---|
| ES | 2185527 | T3 | 5/2003 |
| ES | 2388449 | T3 | 10/2012 |
| JP | 2000-283700 | A | 10/2000 |
| RU | 2256873 | C1 | 7/2005 |
| SU | 607018 | A1 | 5/1978 |
| SU | 922278 | A1 | 4/1982 |
| SU | 1640515 | A1 | 4/1991 |
| WO | WO 01/59401 | A1 | 8/2001 |
| WO | WO 2005/052499 | A1 | 6/2005 |
| WO | WO 2005/071348 | A1 | 8/2005 |
| WO | WO 2006/047823 | A1 | 5/2006 |
| WO | WO 2006/076777 | A1 | 7/2006 |
| WO | WO 2006/076778 | A1 | 7/2006 |
| WO | WO 2006/096920 | A1 | 9/2006 |
| WO | WO 2007/124538 | A1 | 11/2007 |
| WO | WO 2007/124539 | A1 | 11/2007 |
| WO | WO 2010/085837 | A1 | 8/2010 |

OTHER PUBLICATIONS

Extended European Search Report, issued Dec. 16, 2014, for European Application No. 10819734.4.

International Preliminary Report on Patentability (forms PCT/ISA/237 and PCT/IB/373) issued Apr. 3, 2012, for International Application No. PCT/AU2010/001273.

International Search Report (form PCT/ISA/210), issued Nov. 11, 2010 for International Application No. PCT/AU2010/001273.

Peruvian Opposition Brief filed on May 3, 2013 by Famesa Explosivos S.A.C., Case file: 396-2012/DIN, 40 pages total (pp. 1-15 and pp. 1-22), along with an English translation.

Wiggin et al., "Solving the Problems of Precharging Sublevel Caving Rings at Ridgeway Gold Mine," Ninth Underground Operator's Conference, Perth, USA, Mar. 7-9, 2005, pp. 1-10.

METHOD OF UNDERGROUND ROCK BLASTING

This application is a Continuation of copending application Ser. No. 13/498,607, filed on Jun. 11, 2012, which was filed as PCT International Application No. PCT/AU2010/001273 on Sep. 29, 2010, which claims the benefit under 35 U.S.C. §119(e) to U.S. Provisional Application No. 61/246,653, filed on Sep. 29, 2009, all of which are hereby expressly incorporated by reference into the present application.

FIELD OF THE INVENTION

The invention relates to the field of mining, including the blasting and fragmentation of rock. More specifically, the invention relates to the blasting of rock at a location underground.

BACKGROUND TO THE INVENTION

In mining operations, the efficient fragmentation and breaking of rock by means of explosive charges demands considerable skill and expertise. The explosive charges are placed in appropriate quantities at predetermined positions within the rock and are then actuated via detonators having predetermined time delays, thereby providing a desired pattern of blasting and rock fragmentation. Traditionally, signals are transmitted to the detonators from an associated blasting machine via non-electric systems employing low energy detonating cord (LEDC) or shock tube. Alternatively, electrical wires may be used to transmit firing signals to electrical detonators or more sophisticated signals to and from electronic detonators. For example, such signalling may include ARM, DISARM, and delay time instructions for remote programming of the detonator firing sequence. Moreover, as a security feature, detonators may store firing codes and respond to ARM and FIRE signals only upon receipt of matching firing codes from the blasting machine. Electronic detonators can be programmed with time delays with an accuracy down to 1 ms or less.

The establishment of a wired blasting arrangement involves the correct positioning of explosive charges within boreholes in the rock, and the proper connection of wires between an associated blasting machine and the detonators. The process is often labour intensive and highly dependent upon the accuracy and conscientiousness of the blast operator. Importantly, the blast operator must ensure that the detonators are in proper signal transmission relationship with a blasting machine, in such a manner that the blasting machine at least can transmit command signals to control each detonator, and in turn actuate each explosive charge. Inadequate connections between components of the blasting arrangement can lead to loss of communication between blasting machines and detonators, and therefore increased safety concerns. Significant care is required to ensure that the wires run between the detonators and an associated blasting machine without disruption, snagging, damage or other interference that could prevent proper control and operation of the detonator via the attached blasting machine.

Wireless detonator systems offer the potential for circumventing these problems, thereby improving safety at the blast site. By avoiding the use of physical connections (e.g. electrical wires, shock tubes, LEDC, or optical cables) between detonators and other components at the blast site (e.g. blasting machines) the possibility of improper set-up of the blasting arrangement is reduced. Another advantage of wireless detonators relates to facilitation of automated establishment of the explosive charges and associated detonators at the blast site. This may include, for example, automated detonator loading in boreholes and automated association of a corresponding detonator with each explosive charge, for example involving robotic systems. This would provide dramatic improvements in blast site safety since blast operators would be able to set up the blasting array from entirely remote locations. However, such systems present formidable technological challenges, many of which remain unresolved. One obstacle to automation is the difficulty of robotic manipulation and handling of detonators at the blast site, particularly where the detonators are not wireless electronic detonators and require tieing-in or other forms of hook up to electrical wires, shock tubes or the like.

Underground mining presents distinct challenges compared to surface mining. For example, the fragmentation and extraction of a body of ore located underground requires careful planning and execution. Typically, the body of ore is accessed via tunnelling, or one or more drives, to expose a face of the ore on at least one side. Boreholes are then drilled into the face, and loaded with explosive charges. Actuation of the charges by means of associated detonators fragments a portion of the rock behind the free face, thereby to expose a new face to be drilled and loaded. Meanwhile, fragmented rock from the initial blast can be removed via the access tunnel for processing. Through repeated cycles of drilling, loading, blasting and extraction, the exposed face retreats into the ore body and fragmented ore is retrieved.

Extraction of the fragmented ore may be performed using driven vehicles or remotely controlled vehicles, but as noted above remotely controlled location of the detonators in the boreholes and their operative association with the explosive charges has yet to be developed.

Whilst simple in nature, underground blasting as described above presents significant technical and organizational challenges. For example, on the technical side, the void created must be structurally sound, and may require internal support to prevent ceiling collapse. To this end, columns or pillars of ore are frequently left in place to assist in providing ceiling support, particularly during the active phase of blasting and extraction of the remaining ore. Thus, portions of the valuable ore body are effectively "left behind" at the underground blast site, at least until the void has been structurally reinforced, reducing the efficiency of the ore extraction process.

The complexity of underground mining operations is further exacerbated by organizational challenges at the mine site. Teams of mine workers must be co-ordinated carefully in order to optimize both mining operations and access to the free face and fragmented rock. For example, different teams may be required to access the free face at different times to drill boreholes, load explosives, set up blasting equipment, extract fragmented rock etc. Each team will need a different set of equipment to effectively perform its designated task, and yet there may be insufficient space at the free face to accommodate more than one team, and associated equipment, at any given time.

Furthermore, fragmented material from one blast, or a void resulting from that blast, may prevent access to the ore body on a remote side of that blast, again meaning that portions of the valuable ore body are effectively "left behind", at least until the fragmented material has been extracted or access has been otherwise facilitated. Moreover, team movement and co-ordination at the mine site is further complicated by safety concerns. Depending upon the integrity of the rock, or the safety rules at the mine site, it may be a requirement to completely evacuate the mine site of all mining personnel (and perhaps equipment) when blasting takes place. Alternatively, or in addition, it may be necessary to reinforce the remaining rock mass before personnel are allowed to access it for further drilling and blasting. Without such reinforcement, that remaining rock mass may also have to be "left behind". All of these possibilities further constrain the scheduling of all other operations at the mine site for all working faces.

In addition, it may be difficult to access the retreating face of the ore body. Each blasting cycle requires the substantial removal of fragmented rock before the newly exposed ore face can be drilled and loaded for the next blasting cycle. If the rock fragmentation is inefficient or inappropriate in some way, it may be difficult to fully extract the ore via the access tunnel, and this in turn may delay the extraction process. On occasion, undesirable rock fragmentation or throw may result in the ore body being completely inaccessible from an existing access tunnel, such that a new tunnel must be formed to approach the ore body from a different angle. Clearly, this will delay the extraction process, and increase the costs significantly.

It follows that there is a continuing need in the art for improved blasting methods for underground mining. This need extends to blasting arrangements that employ either wired or wireless communication with detonators and associated components.

SUMMARY OF THE INVENTION

It is an object of the present invention to provide methods for improved blasting of rock at an underground location.

In selected exemplary embodiments there is provided a method of blasting rock at an underground blast site, the method comprising the steps of:

a) drilling boreholes in a rock mass;

b) loading each borehole with at least one charge of explosive material;

c) placing at least one detonator in operative association with each charge;

d) conducting a sequence of at least two initiation events to blast the rock mass, in each of which only some of the charges are initiated, by sending firing signals to only the detonators associated with said charges and in which each initiation event is a discrete user-controlled initiation event;

wherein one of the at least two initiation events creates a stranded portion of the rock mass that has been drilled and charged in steps a), b) and c) and said stranded portion of the rock mass is blasted in a subsequent one or more of the at least two initiation events without personnel accessing said stranded portion.

By this method, the efficiency and safety of blasting underground can be greatly enhanced. By pre-drilling all of a selected rock mass or body of ore, or a selected portion of the mass or body, and then charging all of the drilled boreholes as desired and placing the detonators in operative association with the explosive charges, all of the charges may be initiated by at least two distinct initiation events in a desired sequence without personnel having to access any portion of the mass or body between initiation events. This means that a stranded portion of the rock mass can be readily and safely blasted and the fragmented material recovered.

The method of the invention allows entirely new sequences of blasting to be achieved. In particular, it is no longer necessary to perform retreat mining—that is, blasting at the furthest point of the rock mass from an access point—or to drill and blast individual levels at a time. It is now possible to perform steps a), b) and c) to the full height of the rock mass, or selected portion of the rock mass, and, if desired, selectively blast different levels of the rock mass in respective initiation events. The rock mass or selected portion of the rock mass may be between two drives or tunnels, one above the other.

Generally, the boreholes will be drilled in the rock mass from a top drive or a bottom drive, which bottom drive may be the only drive, and in one embodiment the boreholes are drilled in step a) from along the entire length of the drive. Thus, the length of the drive defines the extent of the rock mass that is to be blasted in the at least two initiation events.

The method of the invention requires accurate initiation of the detonators, and in embodiments the detonators may be electric or electronic detonators. In a particular embodiment, the detonators are electronic. Such electronic detonators may be wired or wireless. However, there is a risk that wiring connecting, for example, a blasting mechanism to the detonators that are initiated in a subsequent one of the at least two initiation events may be damaged by the earlier initiation, and for this reason wireless detonators are likely to be selected.

In an embodiment, each detonator forms part of a wireless detonator assembly for receiving and responding to wireless command signals, the step of conducting a sequence of at least two initiation events comprising transmitting at least two wireless command signals from one or more associated blasting machines to selectively FIRE the wireless detonator assemblies.

In a particular embodiment, each wireless detonator assembly is a wireless electronic booster.

In some embodiments, the detonators associated with the subsequent one or more of the at least two initiation events enter a sleep mode prior to their actuation.

Since the charges of explosive material for the subsequent one or more initiation events must be in place during the earlier of the at least two initiation events, the explosive material must be relatively stable, for example ANFO or a bulk emulsion explosive. A suitable bulk emulsion explosive may be selected from the Fortis™ range from Orica Mining Services.

The effect of each initiation event is to fragment the blasted portion of the rock mass, which may then fall into a bottom drive. It may be necessary to extract all or some of that fragmented rock prior to a subsequent one of the at least two initiation events. This may be done remotely, or safely from a portion of the bottom drive that has been drilled and loaded, and that has had at least one detonator placed in operative association with each charge, but that is not unsupported ground so remains stable—that is, it is not a stranded portion of the rock mass.

Such a stranded portion of the rock mass may be a pillar of rock that is left in place after one of the at least two initiation events to support other portions of the rock mass.

In one particular embodiment, the rock mass comprises a body of ore above a bottom drive and the boreholes are drilled in an upwards direction from the bottom drive into the body, the method further comprising forming at least one rise in the ore extending in a generally upward direction from the bottom drive, optionally by actuating detonators and associated charges in at least one borehole, whereby in said one of the at least two initiation events material from the body of ore adjacent the rise is fragmented and falls into the rise and the bottom drive for extraction via the bottom drive, leaving a void, perhaps with unsupported ground, and whereby in a subsequent one or more of the at least two initiation events, remaining material of the body of ore is fragmented and falls at least partly into the void.

In this embodiment, in the subsequent one or more of the at least two initiation events portions of the body of ore adjacent the void and upper ends of the boreholes may be fragmented, and optionally extracted via the bottom drive, prior to the last of the body of ore between said portions and the bottom drive being fragmented.

In one version of this embodiment, said material of the body of ore fragmented in the one of the at least two initiation events is to one side of the rise, in the longitudinal direction of the bottom drive, and said material of the body of ore fragmented in a subsequent one or more initiation events is to the opposite side of the rise.

The portion of the body of ore fragmented in a subsequent one or more initiation events may be above the portion of the body of ore fragmented in the one of the at least two initiation events.

The initiation events may be repeated along the bottom drive. The bottom drive may have one or two blind ends.

In this one particular embodiment, there may be no drive above the bottom drive.

In another particular embodiment, the rock mass comprises a body of ore extending between a bottom drive and an upper drive, said bottom and upper drives each having a corresponding blind end, and the boreholes are drilled in a downwards direction from the upper drive into the body, the method further comprising forming at least one rise in the ore extending between the upper and bottom drives and remote from said blind end of the drives, optionally by actuating detonators and associated charges in at least one borehole, said one of the at least two initiation events being adjacent the rise and leaving a void, perhaps with unsupported ground, and a subsequent one or more of the initiation events being performed in one or more portions of the body of ore between the rise and the blind end of the drives to fragment the material of said one or more portions such that the fragmented material can be extracted via the bottom drive.

In yet another particular embodiment, the rock mass comprises a body of ore extending between a bottom drive and an upper drive adjacent a stope formed between the bottom and upper drives at a remote end thereof and the boreholes are drilled in the body of ore from one of the drives towards the other drive, the method further comprising forming at least one rise in the ore between the bottom and upper drives and remote from said stope to form a portion of the body of ore between the stope and the rise, said one of the at least two initiation events being in the body of ore adjacent said rise to leave a pillar formed from said portion of the body of ore and a subsequent one or more of the at least two initiation events being performed in the residual body of ore to the side of the location of the rise remote from the pillar, followed by extraction of fragmented material from the bottom drive, and a further subsequent one or more of the at least two initiation events being performed to fragment the material of the pillar.

In this embodiment, the stope may be at least partially filled with backfill material, which may be introduced from the upper drive to replace the fragmented and extracted material of the body of ore.

Each of said another particular embodiment and said yet another particular embodiment may be performed using features of said one particular embodiment.

The boreholes in these embodiments may be drilled in any known manner, for example at from 0 to 45° to vertical. In one embodiment, at least some of the boreholes are arranged in a ring of boreholes centred on the drive from which they are drilled for ring-firing of some of the detonators in accordance with pre-programmed delay times.

BRIEF DESCRIPTION OF THE DRAWINGS

Embodiments of methods of blasting according to the invention, and a prior art method, will now be described, with reference to the accompanying drawings, in which.

DEFINITIONS

Figure 1A:
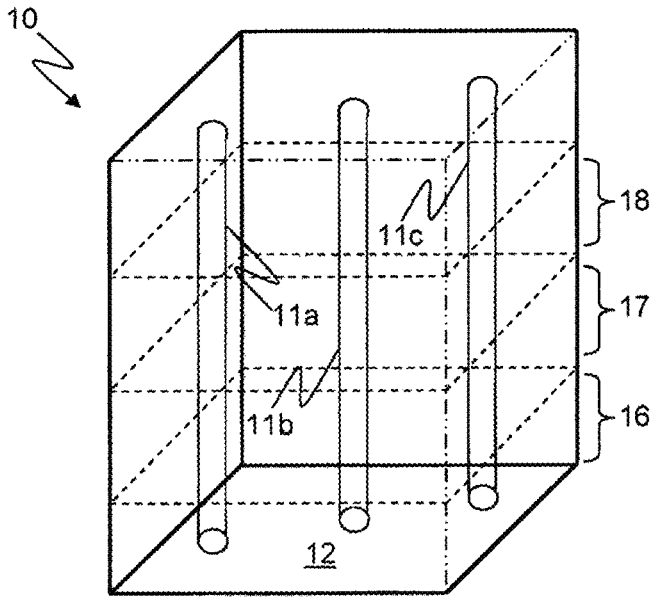
FIG. 1*a* provides a schematic perspective view of body of ore, that may be blasted according to the invention.

Actuate or initiate: refers to the initiation, ignition, or triggering of explosive materials, typically by way of a primer, detonator or other device, such as a booster, capable of receiving an external signal and converting the signal to cause deflagration of the explosive material.

Array: refers to a group of discrete explosive charges, preferably emulsion explosive charges, each located in adjacent borehole in operable association with a detonator such that the charges are located generally within a layer or section of rock, whereby actuation of the charges causes blasting and fragmentation of the layer or section of rock. In selected embodiments, the group of charges forms an array that is substantially arranged about a plane generally perpendicular to a general direction of the axes of the boreholes. In further selected embodiments, the groups of charges that forms an array may be arranged in a manner other than planar. Numerous array configurations and arrangements are known in the art including but not limited to rings, fans, and cuts of various kinds.

Base charge: refers to any discrete portion of explosive material in the proximity of other components of a detonator and associated with those components in a manner that allows the explosive material to actuate upon receipt of appropriate signals from the other components. The base charge may be retained within the main casing of a detonator, or alternatively may be located nearby the main casing of a detonator. The base charge may be used to deliver output power to an external explosives charge to initiate the external explosives charge.

Blasting machine: refers to any device that is capable of being in signal communication with a detonator to actuate the detonator. In the case of electronic detonators, the signal communication may be, for example, to send ARM, DISARM, and FIRE signals to the detonators, and/or to program the detonators with delay times and/or firing codes. The blasting machine may also be capable of receiving information such as delay times or firing codes from the detonators directly, or this may be achieved via an intermediate device such as a logger to collect detonator information and transfer the information to the blasting machine.

Booster: refers to any device that can receive command signals from an associated blasting machine, and in response to appropriate signals such as a signal to FIRE, can cause actuation of a discrete explosive charge that forms an integral component of the booster. In this way, the actuation of the discrete explosive charge may induce actuation of an external quantity of explosive material, such as material charged down a borehole in rock. The booster may be wired or wireless. In selected embodiments, a booster may comprise the following non-limiting list of components: a detonator comprising a firing circuit and a base charge; an explosive charge in operative association with said detonator, such that actuation of said base charge via said firing circuit causes actuation of said explosive charge; a transceiver for receiving and processing at least one wireless command signal from a blasting machine, the transceiver being in signal communication with said firing circuit such that upon receipt of a command signal to FIRE said firing circuit causes actuation of said base charge and thereby actuation of said explosive charge.

Detonator: refers to any form of detonator, but in advantageous embodiments to an electronic or electric detonator, and many forms of detonators are known in the art. As a minimum, a detonator comprises a base charge to be initiated upon receipt of an appropriate signal, and means such as a firing circuit to convey an appropriate signal to actuate the base charge. Typically, many detonators will also comprise some form of shell to contain one or more components of the detonator. Traditionally, a shell is composed of a substantially tubular section of material (e.g. metal) to define a percussion actuation end of the detonator, at which the base charge resides, and an opposite end for connection to other components or signal transmission lines. In selected embodiments, 'detonator' relates to those detonators that include programmable initiation means, for example that include means to store unique detonator identification information, and/or detonator firing codes. The detonator may be wired or wireless. Electronic detonators are known in the art and may include memory means to store data such as delays times, firing codes, or security information, and/or be connected to top-boxes or other components of a wireless initiation device.

Distal: refers to an end of a borehole opposite a proximal end (wherein a proximal end is at, adjacent, or near a free face of rock from which the borehole was drilled into the rock, or from which fragmented rock was removed following blasting of rock at a free face). Such a free face may form part of a drive. The distal end may be a closed end of the borehole some distance away from a free face of rock, for example produced by the penetration into the rock of a drilling device such as a drill bit. In alternative embodiments, the distal end of a borehole may also be an open end if the distal end extends into another drive in the rock remote from the free face.

Drive: refers to a horizontal or generally horizontal cut or void extending underground through, above or below a body of ore. Typically, a drive is formed by fragmentation and extraction of rock, for example by tunnelling. The drive may provide access for mine operators and their equipment to drill boreholes extending into the body or ore in any direction for loading with explosive materials, blasting and fragmentation of the body of ore, for extraction via the drive and drive access. Any underground mine site may include one, a few, or many drives for example at different levels relative to the surface of the ground, or the body of ore. A drive is sometimes referred to herein as a tunnel.

Explosive charge/charge: generally refers to a specific portion of an explosive material in or for placing into a borehole. An explosive charge is typically of a form and sufficient size to receive energy derived from the actuation of a base charge or a detonator, or alternatively energy from explosive material forming part of a booster. The ignition of the explosive charge should be sufficient to cause blasting and fragmentation of the rock. The chemical constitution of the explosive charge may take any form that is known in the art. In some embodiments the explosive charge is of a bulk emulsion explosive that has good stability such as those provided under the Fortis™ brand by Orica Mining Services.

Layer: refers to any layer of rock, in any orientation relative to horizontal, that contains an array of explosive charges associated in use with detonators. The layer may include an array that is arranged in a substantially planar manner in the layer, or an array that is less organized in terms of its geometry. In this way, the detonators associated with the explosive charges may be controlled and actuated within the layer as a group, thereby to selectively fragment the layer as desired in accordance with a designed blast.

Proximal: refers to an end of a borehole at, adjacent, or near a free face of rock from which the borehole was drilled into the rock, or, in some embodiments, from which fragmented rock was removed following blasting of rock at a free face.

Rock: includes all types of rock, including valuable ore. Such valuable ore includes shale. Stranded portion of the rock mass: refers to any portion of the rock mass or ore that is "left behind", or which will be "left behind", at an underground location during a blasting process because it is physically inaccessible as a result of the one and/or an earlier one of the at least two initiation events and/or because it is unsupported ground that is potentially dangerous for personnel to access (so that personnel access may be prohibited under relevant regulation(s)) and/or because it may be required to remain at the blast site to maintain the structural integrity of the blast site, including any void created by extraction of rock ore at the blast site. The stranded portion of the rock mass comprises ore that has value and that in accordance with the invention is blasted in a subsequent one or more of the at least two initiation events without personnel accessing the stranded portion.

Wireless: refers to there being no physical wires (such as electrical wires, shock tubes, LEDC, or optical cables) connecting the detonator of the invention or components thereof to an associated blasting machine or power source. The wireless energy may take any form appropriate for wireless communication and/or wireless charging of the detonators. For example, such forms of energy may include, but are not limited to, electromagnetic energy including light, infrared, radio waves (including ULF), and microwaves, or alternatively make take some other form such as electromagnetic induction or acoustic energy.

Wireless detonator assembly: in general the expression "wireless detonator assembly" encompasses a detonator, most preferably an electronic detonator (typically comprising at least a detonator shell and a base charge) as well as means to cause actuation of the base charge upon receipt by said wireless detonator assembly of a signal to FIRE from at least one associated blasting machine. For example, such means to cause actuation may include signal receiving means, signal processing means, and a firing circuit to be activated in the event of a receipt of a FIRE signal. Preferred components of the wireless detonator assembly may further include means to transmit information regarding the assembly to other assemblies or to a blasting machine, or means to relay wireless signals to other components of the blasting apparatus. Other preferred components of a wireless detonator assembly will become apparent from the specification as a whole. The expression "wireless detonator assembly" may in very specific embodiments pertain simply to a wireless signal relay device, without any association to a detonator unit. In such embodiments, such relay devices may form wireless trunk lines for simply relaying wireless signals to and from blasting machines, whereas other wireless detonator assemblies in communication with the relay devices may comprise all the usual features of a wireless detonator assembly, including a detonator for actuation thereof, in effect forming wireless branch lines in the wireless network. A wireless detonator assembly may further include a top-box as defined herein, for retaining specific components of the assembly away from an underground portion of the assembly during operation, and for location in a position better suited for receipt of wireless signals derived for example from a blasting machine or relayed by another wireless detonator assembly.

Wireless electronic booster: refers to any device that can receive wireless command signals from an associated blasting machine, and in response to appropriate signals such as a wireless signal to FIRE, can cause actuation of an explosive charge that forms an integral component of the booster. In this way, the actuation of the explosive charge may induce actuation of an external quantity of explosive material, such as material charged down a borehole in rock. In selected embodiments, a booster may comprise the following non-limiting list of components: a detonator comprising a firing circuit and a base charge; an explosive charge in operative association with said detonator, such that actuation of said base charge via said firing circuit causes actuation of said explosive charge; a receiver or transceiver for receiving and processing said at least one wireless command signal from said blasting machine, said receiver or transceiver in signal communication with said firing circuit such that upon receipt of a command signal to FIRE said firing circuit causes actuation of said base charge and actuation of said explosive charge. Preferably the detonator is an electronic detonator comprising means to cause actuation of the base charge upon receipt by said booster of a signal to FIRE from at least one associated blasting machine. For example, such means to cause actuation may include a transceiver or signal receiving means, signal processing means, and a firing circuit to be activated in the event of a receipt of a FIRE signal. Preferred components of the wireless booster may further include means to transmit information regarding the assembly to other assemblies or to a blasting machine, or means to relay wireless signals to other components of the blasting apparatus. Such means to transmit or relay may form part of the function of the transceiver.

DETAILED DESCRIPTION OF THE INVENTION

Underground mining operations, including the blasting and extraction of ore bodies located underground, require considerable technical skill and expertise. Compared to surface mining, underground mining requires detailed planning. First, blasting must be conducted in a sequence and manner for optimal access to the ore body both prior to blasting (to set up the explosive charges and detonators), and during and after blasting (to extract the fragmented rock). For example, poor planning of an underground blasting event may lead to unwanted rock fragmentation and movement, such that access tunnels for extraction of the ore become blocked or unusable.

Other complications of underground blasting include the structural integrity of the rock surrounding the body of ore to be fragmented and extracted. During blasting an underground void is created, and techniques are known in the art to help improve the structural integrity of the "walls" and "ceiling" of the void. These include refilling the void, or portions thereof, for example with materials such as previously fragmented waste rock, concrete or cement. Other techniques include "leaving behind" columns or other masses of the ore to be extracted, to help support the roof of the void. Whilst useful, these techniques inevitably reduce the efficiency of the blasting and extraction process, either due to increased costs or the need to leave behind valuable ore at the blast site.

Still further complications of underground mining involve limited access to a free face for blasting and extraction of rock, and the challenges of logistics and co-ordination to bring multiple teams of mine workers (and their equipment) to the free face at appropriate times. Each team is required to perform a specific task at the free face (e.g. drilling or loading boreholes, setting up the blasting apparatus, removal of fragmented rock etc.) Careful management of the teams, and their movement underground, is required to maximize the efficiency of the mining operations. The costs associated with the operation of each team may be significant, and time wasted by any team at the mine site, for example due to poor management and co-ordination of the teams' activities and movement, may result in significant costs and poor efficiency of the mining operation.

Thus the present invention, at least in preferred embodiments, aims to increase the efficiency of mining operations by providing improved methods for the blasting of a body of ore or rock located underground. In selected embodiments, the invention even permits the formation of more than one free-face, such that sequential blasting, rock fragmentation, and removal of a body of ore can occur from more than one direction. In other words, selected methods of the invention permit a body of ore to be fragmented and extracted from more than one 'side', thus alleviating the limitations of extraction via a single free face.

In selected embodiments, the invention disclosed herein extend previous advancements in the art relating to the selective control of detonators or detonator assemblies in groups. For example, WO2010/085837 and its corresponding United States patent application US2010/0212527 published 26 Aug. 2010, which is incorporated herein by reference, discloses examples of methods that are suited to selective control of detonators in groups. The present invention is not limited to the methods of US 2010//0212527 for selective control of detonators at the blast site, and other examples of such selective control methods and apparatuses that are known in the art, or which have yet to be developed in the art, may be applicable to the methods disclosed herein.

Certain exemplary embodiments provide methods for blasting rock at an underground blast site, the methods comprising the steps of: (a) drilling boreholes into the rock, the boreholes having sufficient depth to permit loading of more than one discrete charge of explosive material; (b) loading each borehole with said more than one charge, such that the charges in adjacent boreholes form layers of discrete charges; (c) placing detonators in operative association with the charges of each layer; and (d) selectively actuating the detonators and associated charges of the layers, thereby to fragment some or all of the rock in each layer according to a desired blasting sequence for the layers.

Figure 1B:
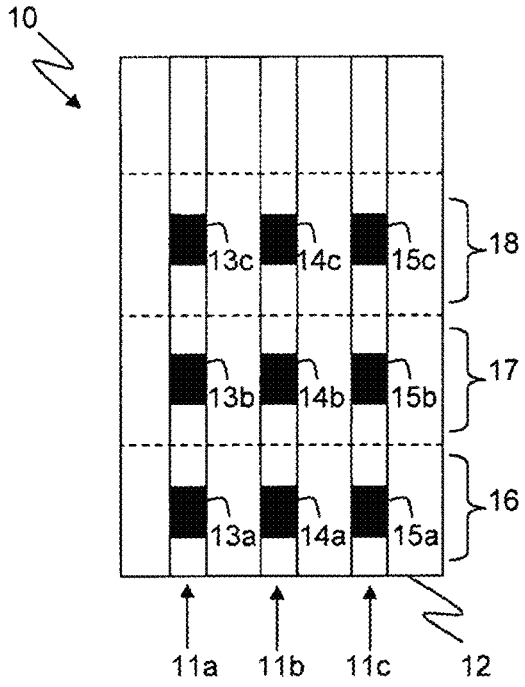
FIG. 1*b* provides a schematic sectional view of the body of ore illustrated in FIG. 1*a* taken along the boreholes.

Such embodiments are illustrated by way of example only with reference to FIG. 1, where FIG. 1*a* provides a schematic perspective view of a body of rock to be blasted, and FIG. 1*b* provides a schematic sectional view of the same body of rock. The body shown generally at 10, has a series of boreholes 11*a*, 11*b*, 11*c* drilled therein and extending from exposed face 12 in an upright, substantially vertical direction through the rock. Whilst FIG. 1 illustrates substantially vertical boreholes, it will be appreciated that this orientation is merely for illustrative purposes, and other orientations than substantially vertical may be desired depending upon the circumstances of the blast site and the design of the blast. In one embodiment, the boreholes may form part of a ring of boreholes extending from the exposed face 12. The exposed face 12 may be in a drive or other void at the blast site.

Regardless, in a manner typical for blasting operations, the boreholes 11*a*, 11*b*, 11*c* extend into the rock in an upwardly direction from the exposed face 12 of the body 10. The boreholes 11*a*, 11 *b*, 11*c* have sufficient depth for the loading therein of more than one explosive charge and may open into another drive or other void at their distal ends or may be blind. For the sake of illustration, three explosive charges are shown to be loaded in each borehole, with explosive charges 13*a*, 13*b*, 13*c* being loaded in borehole 11*a*, explosive charges 14*a*, 14*b*, 14*c* being loaded in borehole 11*b*, and explosive charges 15*a*, 15*b*, 15*c* being loaded in borehole 11*c*. Explosive charges 13*a*, 14*a*, and 15*a* each located in adjacent boreholes may be considered to lie within a first layer 16 within the body 10, wherein layer 16 consists of a portion of rock directly adjacent face 12. Likewise, explosive charges 13*b*, 14*b*, and 15*b* lie within layer 17 of body 10 adjacent to layer 16. Finally, explosive charges 13*c*, 14*c*, and 15*c* lie within layer 18 of body 10 adjacent to layer 17. Further boreholes, explosive charges and layers may also be present although these are not shown in FIG. 1 for the sake of simplicity.

A respective detonator (not shown) is placed in operative association with each explosive charge such that actuation of each detonator causes actuation of its associated explosive charge. The detonators may be controlled via wired or wireless communications with an associated blasting machine, such that they are selectively actuated. They may be selectively actuated in groups, with each group corresponding to detonators and explosive charges located within each layer 16, 17, 18 in body 10. In this way, each layer may be selectively fragmented in accordance with a desired sequence for the layers. For example, the blast operator may desire to actuate first those detonators and associated explosive charges 13*c*, 14*c*, and 15*c* located in layer 18 of body 10, at the distal ends of the boreholes 11*a*, 11*b*, 11*c* relative to face 12, with subsequent actuation of the explosive charges in the other layers 16 and 17. The fragmented material may fall into a rise or other void (not shown) adjacent the illustrated body 10 and into the drive beneath exposed face 12 for extraction. The blast in layer 18 may result in a stranded portion of the rock mass, for example in the layers 16 and 17 and/or above the location of layer 18. However, the layers 16 and 17 may still be blasted safely in a subsequent one or more initiation events because the boreholes have already been formal and loaded with explosive charges 13*a*, 14*a*, 15*a* and 13*b*, 14*b*, 15*b* and had detonators placed in operative association with the charges. Thus, personnel access is not necessary.

In variations, given by way of example only, the layer 16 may be blasted first, leaving layers 17 and 18 as stranded portions of the rock mass but that may be blasted safely because they have already been prepared for blasting, or charges 14*a-c* may be initiated first to form a rise, followed by charges 13*c*, 15*c* to leave stranded portions that can still be blasted safely. Alternatively, all of the explosive charges in boreholes 11*a* and 11*c* may be initiated in one or more discrete initiation events, to leave a pillar or column of rock with charged borehole 11*b* through it. The pillar or column of rock may be fragmented at a later time by initiation the explosive charges 14*a, b, c* in a subsequent discrete user-controlled initiation event without personnel access.

In accordance with the methods disclosed, it is no longer necessary to drill (boreholes), load the boreholes with explosive charges and associated detonators, blast and extract portions of rock in a progressive manner commencing with the portion of rock nearest the exposed face. Instead, all of the drilled boreholes are loaded with explosive charges and associated detonators and the charges, or groups or arrays of them, are initiated sequentially in discrete user-controlled initiation events. The blast operator can now choose which portions of rock are fragmented first, regardless of their position relative to the exposed face, in accordance with a desired blast plan.

As discussed, the detonators associated with the explosive charges may be electronic and controlled by one or more associated blasting machines issuing command signals for the sequential initiation events. The command signals may take any form, including signals transmitted over a wired network or harness, or alternatively they may be wireless command signals communicated via any wireless means, including electromagnetic signals such as radio signals. The use of wireless command signals, including the transmission of wireless command signals through the ground, has been proposed in, for example, international patent publications WO2006/047823, WO2006/076777, WO2006/096920, and WO2007/124539, all of which are incorporated herein by reference.

The detonators associated with the explosive charges that are initiated in a later or subsequent one or more discrete user-controlled initiation events may be caused to enter a "sleep" mode prior to their initiation. The sleeping detonators (i.e. those that have entered a sleep mode) may remain in an inactive state for an extended period of time, prior to their subsequent actuation. In this way, the selected explosive charges and their associated detonators may be forced to enter a sleep period wherein the sleeping detonators are unable to actuate absent a special command signal.

Fragmented ore derived from blasting in the at least one initiation event may be extracted by automated (e.g. robotic) means, especially where the structural integrity and safety of the unsupported void is questionable.

The inventors have identified significant advantages to the combined use of relatively stable explosives (such as bulk emulsion explosive materials or other explosive materials such as slurry explosives; ANFO; dynamites; black powder; propellants) with electronic detonators to extract stranded portions of the rock mass in a subsequent one or more of the at least two blast initiation events. For example, both emulsion explosives and electronic detonators, at least in selected embodiments, may be resistant to degradation by contact with water. Emulsion explosive materials may withstand extended periods in a borehole prior to actuation. Electronic detonators may comprise at least substantially sealed casings and/or be integrated into detonators assemblies that include a housing to at least substantially prevent egress of water and dirt. For example, electronic boosters are known in the art, which include a housing for containing a portion of explosive booster material, and a detonator in operable association with the explosive booster material. International patent publication WO2006/096920, which is incorporated herein by reference, discloses a wireless electronic booster that is substantially sealed, that is robust for underground placement and which is capable of receiving wireless command signals, for example LF radio signals through rock.

Thus, to summarise steps (a) to (c) occur in all of the rock mass to be blasted in the at least two initiation events, prior to conducting the at least two initiation events in step (d). Therefore, the invention includes embodiments in which the drilling and loading of the boreholes within what will become the stranded portion of the rock mass, or the "stranded ore", with emulsion explosives and electronic detonators occurs before the fragmentation and extraction of ore surrounding the stranded ore in the one initiation event. In this way, an entire volume of underground ore may be drilled and loaded ready for blasting, but only selected portions of the volume may be fragmented and extracted by way of an initial initiation event, leaving behind selected portions of unfragmented ore for example to help maintain the structural integrity of the underground void or that are otherwise stranded ore. However, since the selected portions of the underground ore have already been drilled and loaded with a combination of emulsion explosive material and electronic detonators, the detonators may be required to enter a "sleep mode" and remain inactive, possibly for an extended period, until the subsequent one or more of the at least two initiation events. Once the period has elapsed, a mine operator may then choose to fragment and extract the selected portions of unfragmented ore that were left behind after the initial blasting cycle. For example, a wireless command signal to FIRE may be transmitted from a blasting machine located at or above a surface of the ground, through the ground to the wireless electronic detonators located within the selected portions of unfragmented rock in association with emulsion explosives. In this scenario, the preloading of pillars or other support structures, or other stranded ore, with a combination of emulsion explosives and wireless electronic detonators permits the pillars and support structures to be "dropped" at a later date from a location above the ground, without need for personnel or equipment to be present in the underground blast site. If the underground blast site remains safe, in spite of the fragmentation of the pillars or other support structures, or other stranded ore, then the fragmented ore derived from blasting the stranded ore may then be extracted either by conventional or automated means.

In selected embodiments, in step (a) of the method each borehole is drilled to a depth sufficient to be loaded in step (b) with more than one discrete charge such that the charges in adjacent boreholes form layers of discrete charges, and in step (d) the detonators and associated charges of each layer are selectively actuated, thereby to fragment the rock about each layer in the pillar or mass of rock according to a desired blasting sequence for the layers. For example, each layer of charges may comprise a substantially planar array of discrete charges located in adjacent boreholes, each substantially planar array being arranged about a plane generally perpendicular to the axis of the boreholes. Each planar array may be oriented at any angle relative to horizontal. For example, each substantially planar array may be arranged about a plane that is at least substantially horizontal or vertical, or a plane that intersects a horizontal plane at an angle of from 0 to 90 degrees. In selected embodiments, at least some of the layers are blasted in a sequence commencing with a layer at the distil ends of the boreholes, with subsequent blasting of layers retreating towards the proximal ends of the boreholes. In this way, a void may be created in the rock at a location remote from the rock face, thereby to generate a support pillar or other support structure between the face and a new face created by blasting layers in a retreating sequence towards the proximal ends of the boreholes.

Still further embodiments include methods for extracting a body of ore extending above a drive formed across a lower portion of the body. Such methods are encompassed by and expand upon previously described embodiments of the invention, to permit extraction of a large volume of ore from a single drive, with reduced need for multiple drives, as will be evident from the following description and accompanying figures. In selected embodiments such methods further comprise forming at least one rise in the ore extending in a generally upward direction from the bottom drive whereby in said one of the at least two initiation events material from the body of ore adjacent the rise is fragmented and falls into the rise and the bottom drive for extraction via the bottom drive, leaving a void, and whereby in a subsequent one or more of the at least two initiation events, material of the body of ore is fragmented and falls at least partly into the void.

Whilst this method, at least upon initial consideration, appears to be fairly simple in nature, the provision of a single drive to extract the entire body of ore is enabled with only one cycle of drilling and loading the boreholes, and placing the detonators, by virtue of selective actuation of detonators. Further advantages of such methods, as well as additional steps, will become apparent from the following description of FIGS. 2 and 3, as well as of subsequent Figures.

FIGS. 2 and 3 provide a comparison of known techniques in the art for extraction (also known as stoping) of a body of ore extending upwardly in a slanting direction, as shown by each accompanying cross-section through the body A-A'. Whilst FIGS. 2 and 3 illustrate a slanting body of ore, this type of ore body is merely shown for illustrative purposes, and the methods disclosed herein will apply to a wide range of ore body orientations and configurations.

Figure 2A:
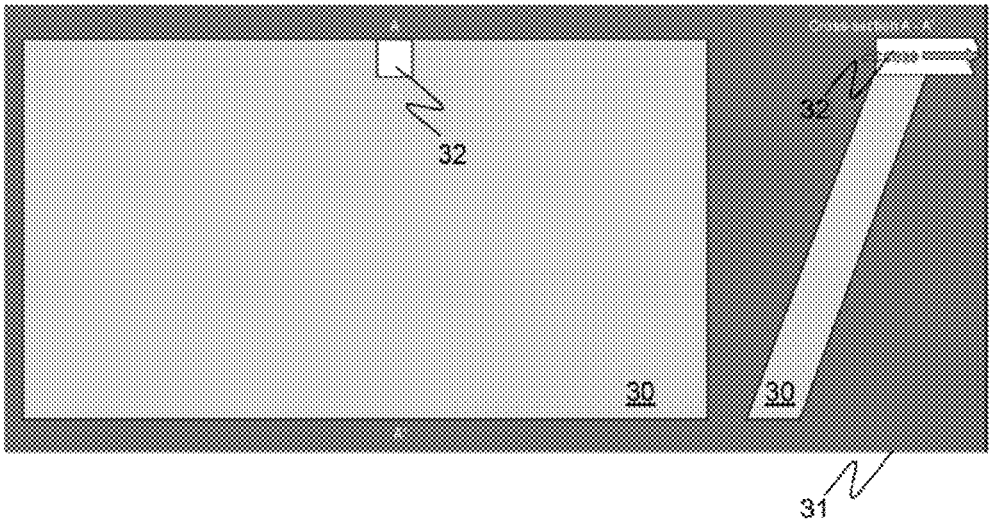
FIG. 2*a-h* illustrate sequential stages in the blasting and extraction of a body of ore located underground, in accordance with methods that are known in the art.
Figure 2B:
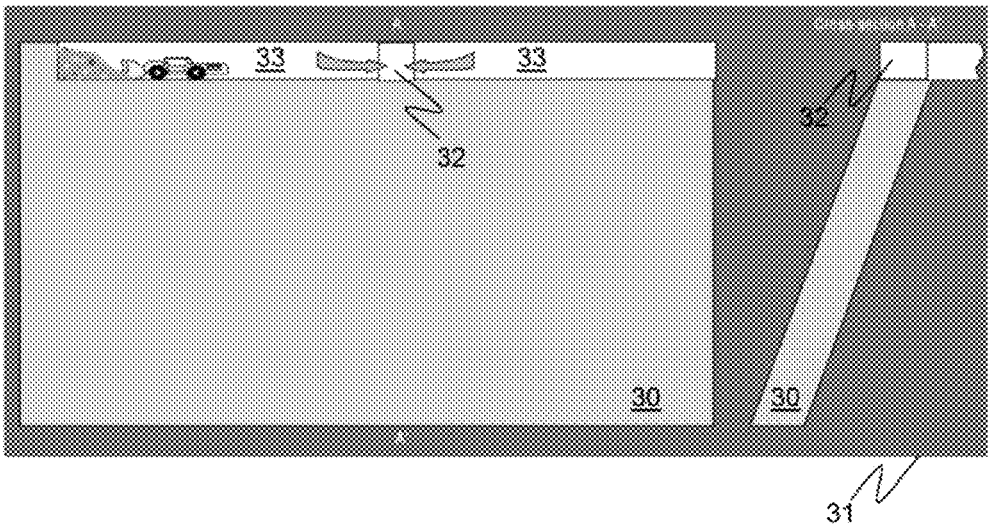
FIGURE 2b PRIOR ART
Figure 2C:
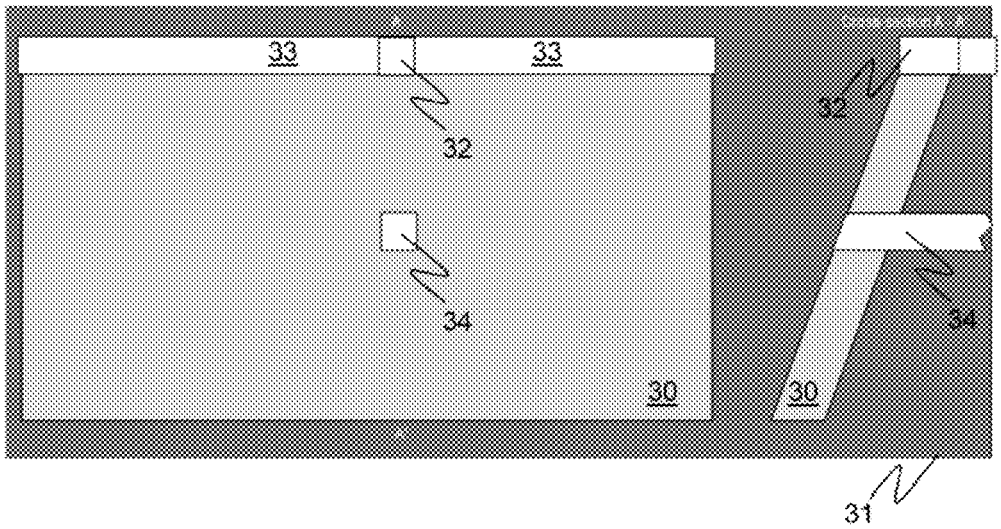
Figure 2D:
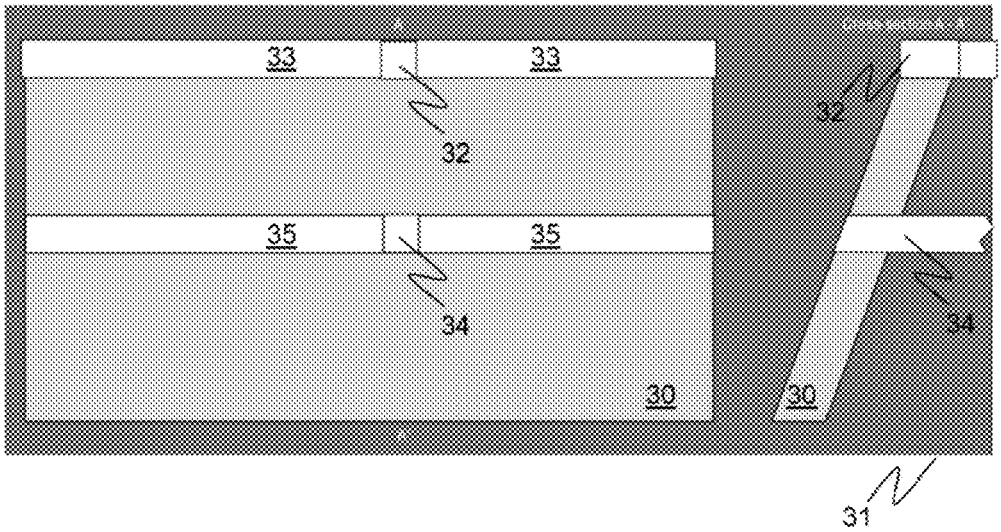
FIGURE 2d PRIOR ART
Figure 2E:
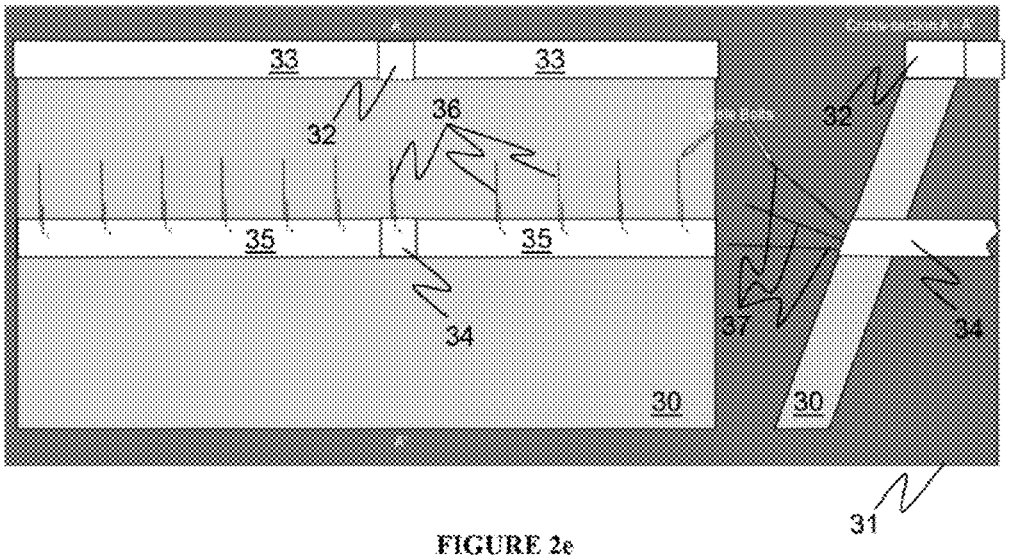

FIGS. 2*a* to 2*h* illustrate techniques that are known in the art for blasting and extraction of the body of ore shown generally at 30, which is located underground and at least substantially surrounded by other underground rock or material 31. FIGS. 2*a* to 2*h* show progressing in sequential events to fragment and extract the ore in a series of stages, commencing in FIG. 2*a* with the formation of upper drive access 32 at the centre-top portion of body 30. In FIG. 2*b* upper drive access 32 is expanded to form upper drive 33. In FIGS. 2*c* and 2*d* the process is repeated, first by forming middle drive access 34 in FIG. 2*c*, and then by expansion of middle drive access 34 to form middle drive 35 in FIG. 2*d*. In FIG. 2*e* cables and cable bolts are shown generally at 36 to help shore up slanting roof portion 37 of drive 35 (as shown in the cross-section A-A' of FIG. 2*e*).

Figure 2F:
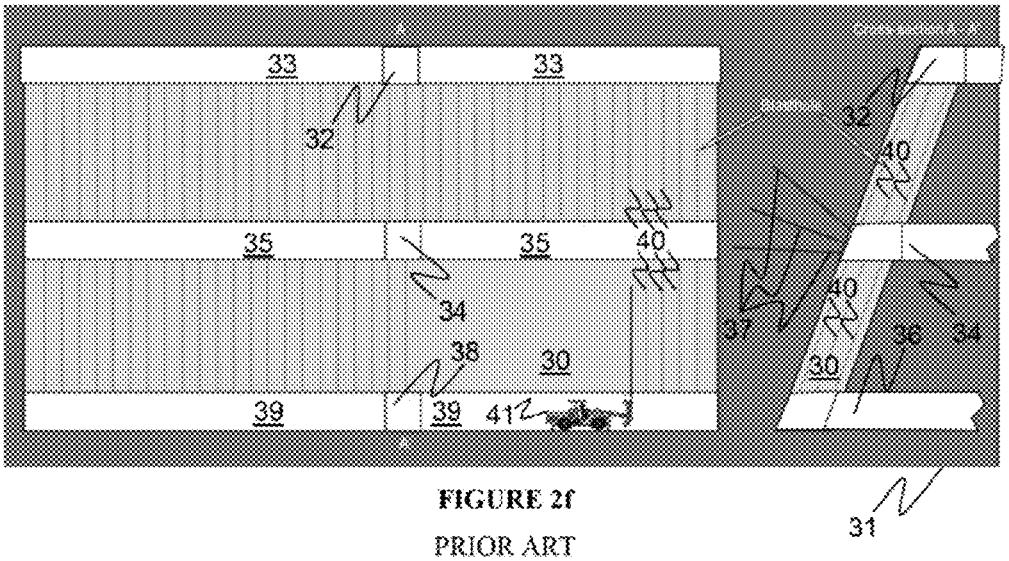
FIGURE 2f PRIOR ART
Figure 2G:
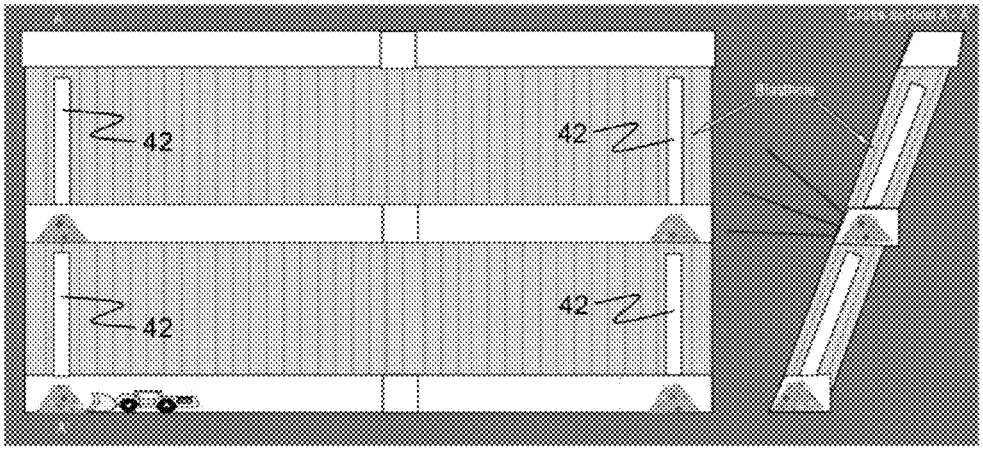

In FIG. 2*f* the process of drive formation is repeated once again, first to form lower drive access 38 and then lower drive 39. Boreholes 40 are subsequently drilled into the remaining body 30 by accessing the upper, middle, and lower drives (33, 35, 39). Indeed, apparatus 41 is shown in the lower drive 39 in the process of drilling boreholes 40 into a portion of body 30 located between lower drive 39 and middle drive 35. Cross-section A-A' illustrates how boreholes 40 are drilled in an upwardly slanting direction, generally in parallel with the general upward slant of the body of ore 30. Next, as shown in FIG. 2*g*, selected boreholes adjacent the opposed blind ends of the drives, loaded with detonators and associated explosive charges (e.g. emulsion explosive charges) are actuated, for example by transmission to the detonators of a command signal to FIRE from an associated blasting machine. The result, as shown in FIG. 2*g*, is the fragmentation and fall of rock around those boreholes into middle drive 35 and lower drive 39, resulting in fragmented rock piles for extraction via the drives 35, 39 and drive accesses 34, 38 to form narrow rises 42 clearly shown at one end in the cross-section A-A'.

Figure 2H:
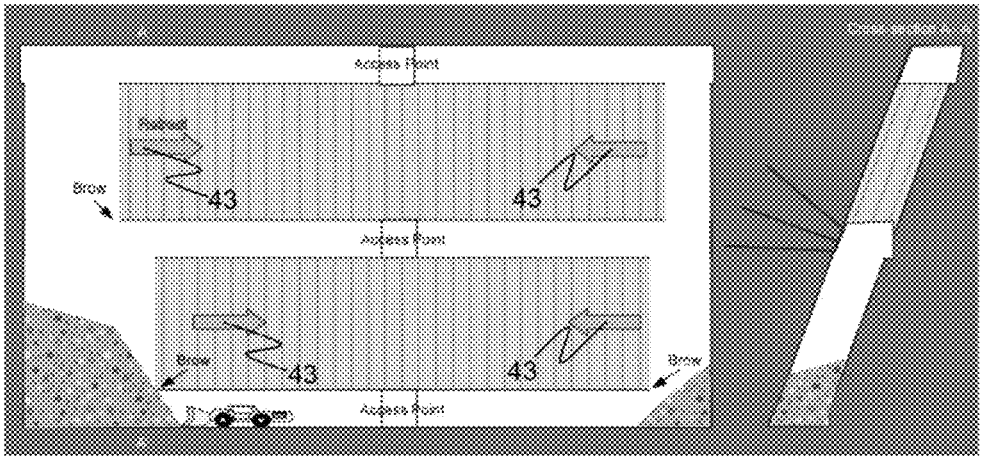
FIGURE 2h PRIOR ART

Subsequently, as shown in FIG. 2*h*, boreholes 40 immediately adjacent the rises 42, and on opposite sides of them, are loaded and blasted and then adjacent remaining boreholes 40 are loaded and blasted in a retreating sequence, illustrated by arrows 43. Drives 33, 35, 39 are required to access and load the boreholes for each cycle of blasting, such that the retreating sequence of rock fragmentation can be achieved. Note cross-section A-A' in FIG. 2*h*, which illustrates how the lower portion of body 30 between the middle drive 35 and lower drive 39 is blasted in a retreating manner slightly ahead of the blasting of the upper portion of body 30 between upper drive 32 and middle drive 35. In this way, the fragmented rock tends to fall to the lower drive 39, the lowest portion of the underground blast site, for extraction via lower drive 39 and drive access 38. Generally, the extraction is by means of automated vehicle, as shown, since it is unsafe for personnel to pass beyond the brow, the outermost lower corner, of the remaining rock mass at any time.

In accordance with the prior art embodiments illustrated in FIG. 2, multiple drives are required to form the boreholes 40, and then to access and load them at all levels of the body 30, and sequential firing of the boreholes in a linear retreating sequence is required to maintain access to the ore body. The design of the underground mine, and the blasting and extraction sequence is driven by ore body geometry and drive access, which must be maintained through all stages of the operation to ensure accessibility to the boreholes for loading and proper communication with a blasting machine.

In contrast, the methods of the present invention permit loading of charges in all boreholes in a single cycle, with the option of multiple charges into each borehole, with selective control of the charges and associated detonators in at least two user-controlled initiation events.

FIGS. 3*a* to 3*h* show a progressive sequence of events for an exemplary embodiment of a method of blasting or extracting rock from an underground location, in accordance with the teachings herein. For each figure, a cross-section A-A' is provided to aid understanding and orientation of the rock to be extracted. As for FIG. 2, FIG. 3 illustrates a body of ore extending at an upward slant relative to horizontal. However, this arrangement is for illustrative purposes only, and the methods disclosed herein may be applied to many if not all other arrangements and orientations for the body of ore.

Figure 3A:
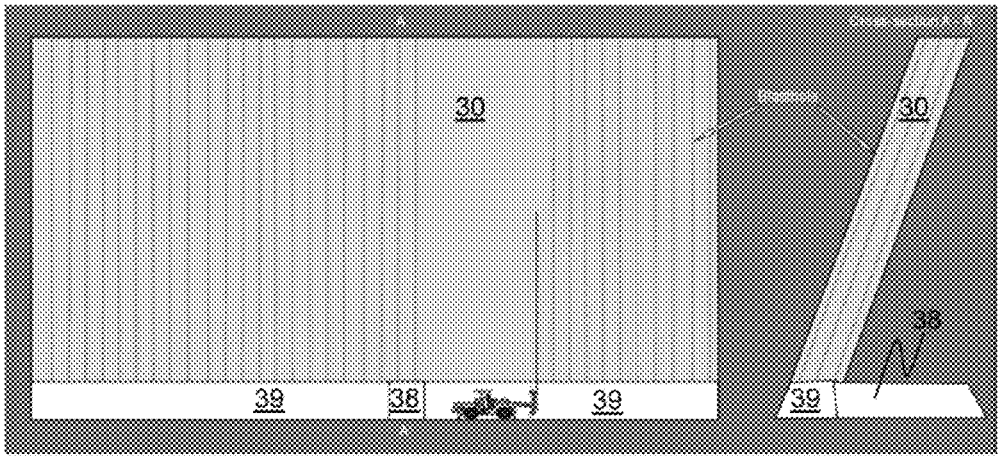
FIG. 3*a-h* illustrate sequential stages in the blasting and extraction of a body of ore located underground in accordance with an embodiment of the method of the invention.

With specific reference to FIG. 3*a*, the body of ore is shown generally at 30, with the rock surrounding or adjacent the body shown at 31. Only a single lower access drive 38 and lower drive 39 is required to instigate extraction of the entire body of ore 30. Boreholes 40 are drilled from drive 39 in a generally upward direction along the full length of the drive 39 and the body of ore, for example by apparatus 41, such that they extend for a significant length to the upper regions of body 30. All the boreholes are then loaded with explosive charges (not shown), for example comprising emulsion explosives, in multiple decks separated by stemming and one or more detonators are placed in operative association with the explosive charges. Preferably the detonators are wireless as previously described. As required, the charges are placed at pre-determined locations along the lengths of the boreholes. In preferred embodiments, the detonators and associated charges can be selectively actuated in groups, but as will become apparent the method of blasting comprises sequential initiation events by a blasting machine, each of one or more explosive charges across one or more boreholes and each a discrete user-controlled initiation event. Thus, for example, a user must act to initiate each initiation event at a desired time.

Figure 3B:
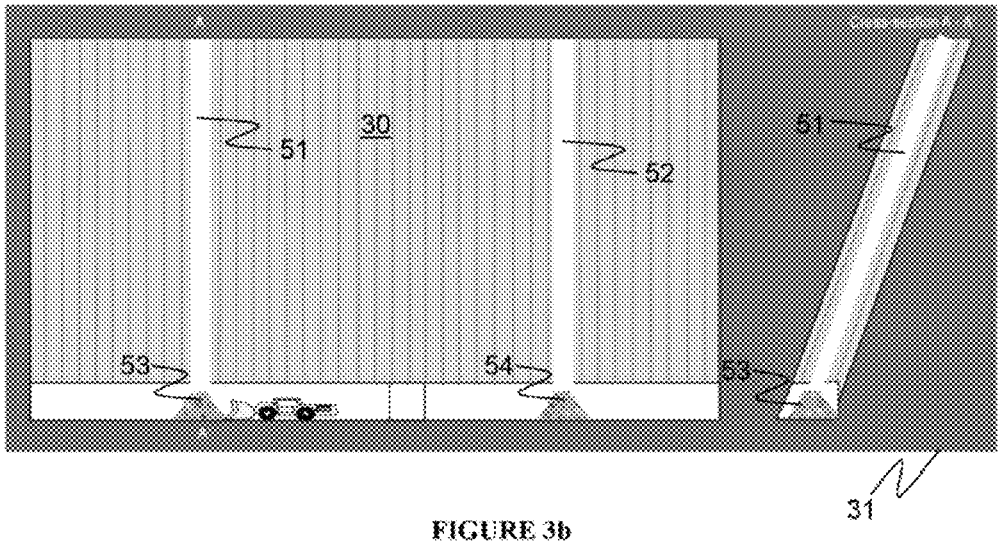
Figure 3C:
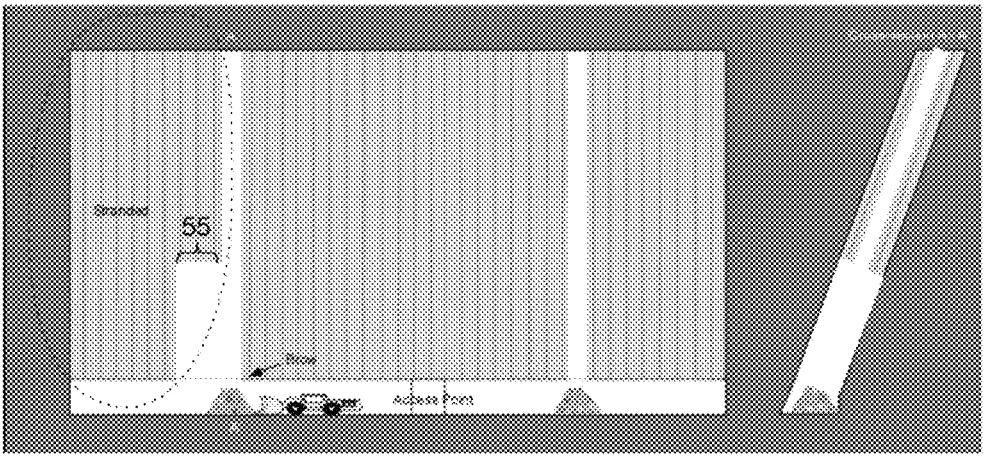

In FIG. 3*b*, those detonators and associated charges within two selected boreholes, each midway between the access drive 38 and the respective blind end of the drive 39, and optionally within adjacent boreholes, have been selectively actuated to form two upwardly extending rises or voids 51, 52 in the body 30, with fragmented rock derived from this initial blast falling into drive 39 to form piles 53, 54 for remote extraction via drive 39 and access drive 38. Those portions of the body of ore 30 beyond the rises 51, 52 are of stranded ore. Subsequently, as shown in FIG. 3*c*, without any personnel accessing the areas beyond rises 51, 52, those detonators and charges in boreholes 55 adjacent rise 51 are selectively actuated thereby to widen rise 51, again with the fragmented material being removed by remote control of the extractor.

Figure 3D:
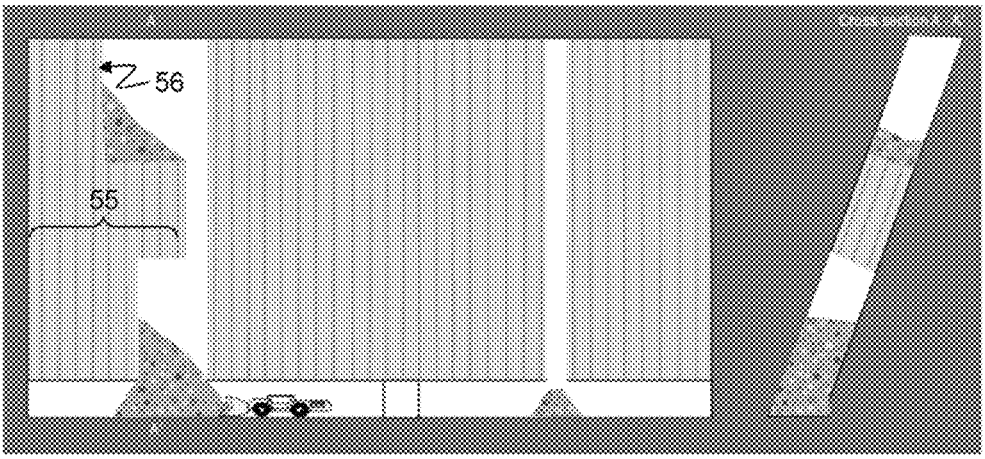

In FIG. 3*d*, detonators and charges at the upper, distal ends of boreholes 55 are selectively actuated, such that fragmented rock falls to lower drive 39 via void 51, thereby to widen the upper portion of rise 51 by the retreat of the rock shown by arrow 56. Again, the resulting fragmented rock is extracted from the site via lower drive 39 and drive access 38. By virtue of the methods disclosed herein, detonators and explosive charges are actuated at the distal ends of the boreholes, such that the resulting fragmented rock can fall into, and be extracted from, lower drive 39, so that the selective control and actuation of the detonators obviates the need for multiple drives at the underground mine site. This is because the methods disclosed herein circumvent the prior need to both load and actuate explosives in boreholes in a retreating sequence, to maintain safe physical access. Instead, the methods disclosed herein permit the detonators and associated charges to be selectively actuated, sequentially individually or in groups, regardless of their position relative to an open face or drive. This in turn opens the door to a wide variety of blasting patterns and sequences, one example of which is illustrated in FIG. 3.

Figure 3E:
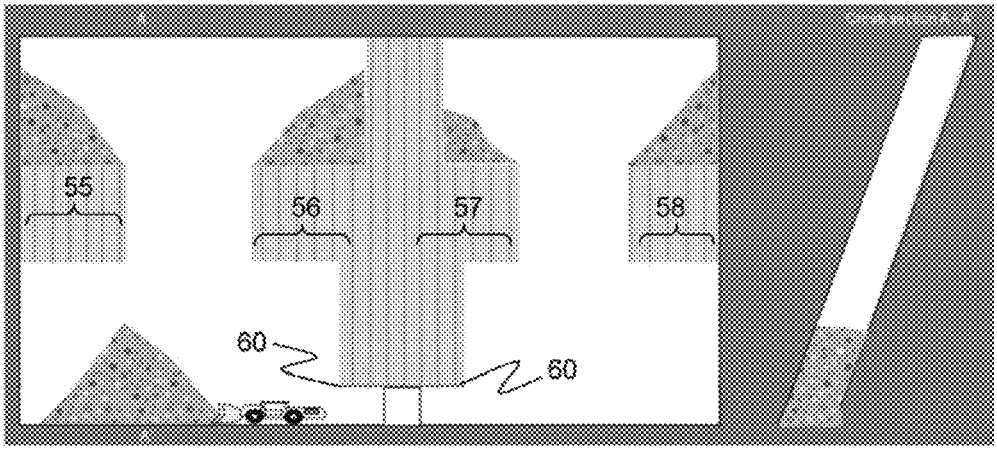

In FIG. 3*e*, further selective actuation of groups of detonators has occurred both to widen initial rise 52, and to fragment rock adjacent boreholes extending each side of initial rises 51 and 52. In particular, layers of detonators and associated charges in the upper regions of body 30 associated with boreholes 56 have been actuated to fragment adjacent rock such that the resulting fragmented rock falls down (now widened) rise 51 and into drive 39 for extraction. Likewise, layers of detonators and associated charges in the upper regions of body 30 associated with boreholes 57 and 58 have been actuated to fragment adjacent rock such that the resulting fragmented rock falls down (now widened) rise 52 and into drive 39 for remote controlled extraction. Lower layers of detonators and associated explosive charges associated with boreholes 55, 56, 57 and 58 have also been actuated, again to cause adjacent rock to fragment and fall into drive 39 for remote controlled extraction. Once again, the ability to selectively actuate the detonators and associated charges in groups, regardless of their position at the blast site relative to the drives, permits the body 30 to be fragmented and extracted in virtually any desired pattern, and extracted via lower drive 39. Remote controlled extraction of the fragmented fallen rock in drive 39 is required because the extractor vehicle is moving beyond the nearest brows 60 of stable rock to the access drive 38 without the rock in the void beyond the brows having been stabilised.

Figure 3F:
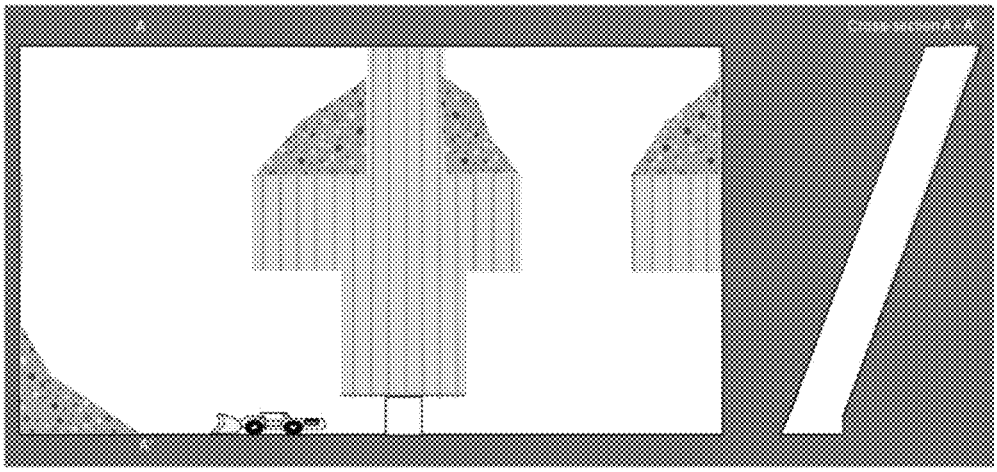
Figure 3G:
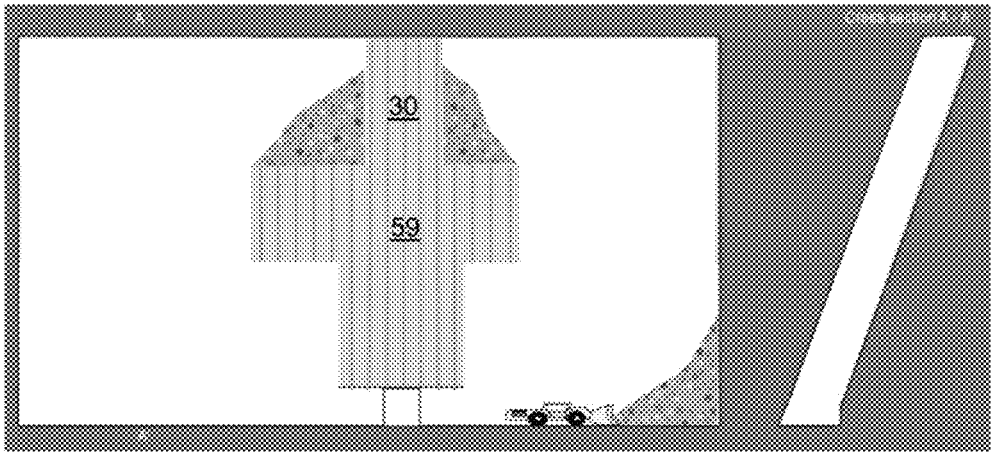

In FIG. 3*f*, yet further selective actuation of the remaining detonators and charges in boreholes 55 has occurred, such that the stranded ore from the left side of the body (as seen in the Figure) has been completely removed. Likewise, in FIG. 3*g* yet further selective actuation of the remaining detonators and charges in boreholes 58 has occurred, such that the stranded ore from the right side of the body (as seen in the Figure) has been completely removed. Essentially, a central column or pillar of unfragmented ore 59 remains at the blast site, and this column may, if required for structural reasons, be left in place for an extended period, for example until mine personnel and equipment have been evacuated from the immediate proximity of the blast site. The detonators and associated charges located in column 59 may enter a sleep mode for an extended period until a suitable time to "drop" (i.e. fragment) and extract the column ore material. Alternatively, if the structural integrity of the site is of little or no concern, further selective blasting of upper layers of column 59 may quickly occur.

Figure 3H:
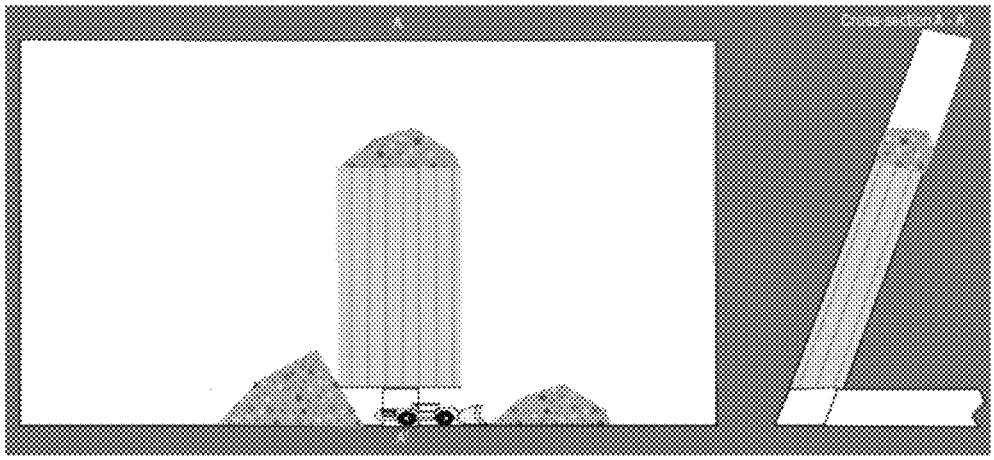

The selective blasting of the upper layers of column 59 and then of the remaining rock in the body of ore 30 is shown in FIG. 3*h*. This is continued to complete the fragmentation and extraction of the entire body 30 from the blast site via the single drive 39 and access drive 38.

Therefore, by comparing the sequence of events across FIGS. 2 and 3, it can readily be seen that the methods disclosed herein present significant advantages over those of the prior art. The following steps in this embodiment of the invention, which involve selective actuation of detonators and associated charges in groups within boreholes, greatly widens the options available to a blast operator when designing the blasting and extraction sequence: (a) drilling boreholes in a generally upward direction from a lower drive into the body, or downwardly from an upper drive into a lower drive; (b) loading all the boreholes with at least one, and usually more than one, charge of explosive material (e.g. emulsion explosive material, or other relatively stable explosive material); (c) placing detonators in operative association with the charges; (d) forming at least one initial rise in the ore extending in a generally upward direction from the drive, optionally by actuating detonators and associated charges in at least one borehole; (e) selectively actuating the detonators and associated charges of an upper portion of the ore body at the distal/upper ends of the boreholes adjacent the at least one rise, thereby to fragment the rock of the upper portion such that the fragmented rock falls down the at least one rise and into the lower drive, for extraction via the drive. The methods include the selective actuation of the detonators and associated charges in further portions in a progressive sequence retreating from said distal/upper ends of the boreholes adjacent the at least one rise, thereby to fragment the rock of the further portions, such that the fragmented rock falls down the at least one rise and into the drive, for extraction via the drive, thereby to widen the rise.

Figure 4:
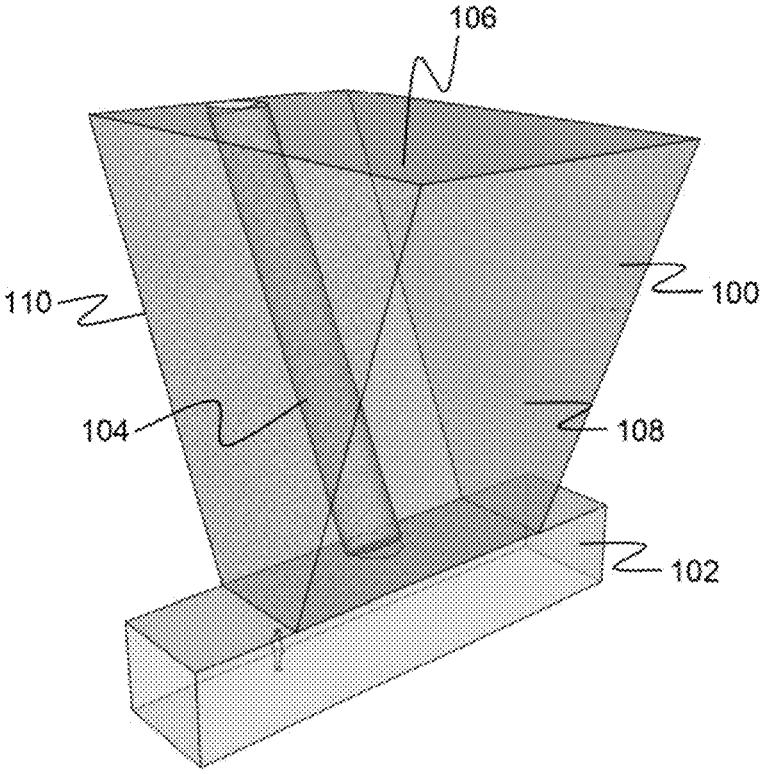
FIG. 4 is a schematic perspective view of the first stage of one embodiment of a drawbell blast in accordance with the invention.
Figure 5:
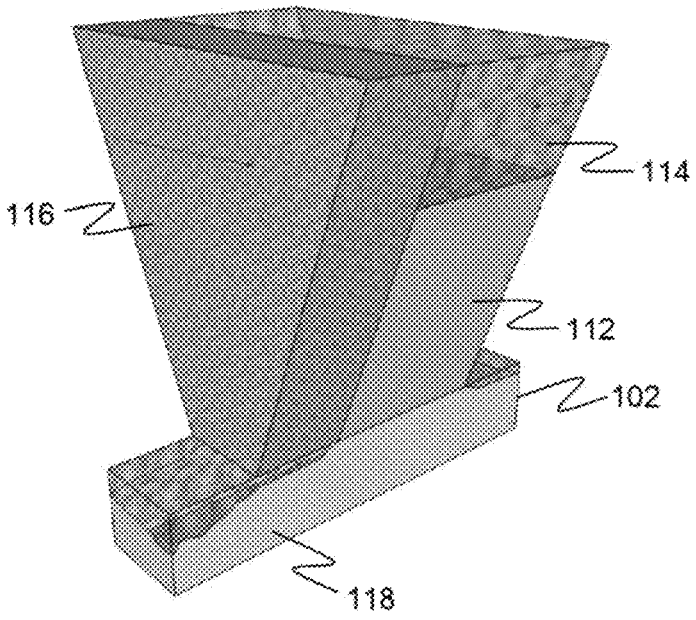
FIG. 5 is a view similar to FIG. 4, but showing the second stage of the blast.

Turning now to FIGS. 4 and 5, there is shown an example of drawbell firing using an embodiment of the method of the invention. A drawbell is a body of ore 100 that expands upwardly and outwardly from the bottom of the body, where a bottom drive 102 is shown as having been formed. Thus, the body 100 tapers downwardly and laterally, relative to the length of the drive 102, to the drive.

Drawbell mining is a standard part of block cave mining and other large scale underground mining methods. Typically, the drawbell, the body of ore 100, is blasted in two stages because the available void, the drive 102 and a rise 104 formed in the body of ore, is not sufficiently large to fire the drawbell in one blast without risk of "freezing" the fragmented ore.

Typically, the drawbell 100 is predrilled with boreholes (not shown for the sake of clarity) that extend in a series of fans or rings regularly spaced along the body (in the direction of the drive 102) from the bottom drive 102 to the top 106 of the body, or adjacent to the top. Thus, the outermost boreholes in each fan would extend substantially parallel to the inclined lateral faces 108 and 110 of the drawbell, while the intermediate boreholes will extend at gradually reducing angles to a central, approximately vertical one.

The rise 104 is formed adjacent the lateral face 110 by loading one or more of the boreholes at that location with explosive charges and associated detonators, and initiating those charges. The fragmented material will fall through the resultant void into the bottom drive 102 for remotely controlled extraction or otherwise. At this stage, the drive 102 beneath the drawbell 100 is still safe for personnel access because they may pass through the drive 102 without being beneath the void created by the rise 104. Extracted material may be removed from the bottom drive 102 by way of an access drive (not shown) at the left hand end of the drive 102 (in the Figure).

Traditionally, boreholes in the body of ore 100 to the side of the rise 104 remote from the access drive would then be loaded with explosive charges and associated detonators and fired to fragment the whole body of ore, or a selected portion of it, to that side of the rise 104. The fragmented material expands into the rise 104 and falls into the bottom drive 102. This is shown in FIG. 5, with the fragmented material referenced 112. As the fragmented material falls into the bottom drive 102, a void 114 is created above it.

Access to the remaining portion 116 of the body of ore closer to the access drive is prevented by the fragmented rock 118 in the bottom drive 102, and this must be removed remotely or otherwise prior to blasting of the portion 116.

Prior to the portion 116 being blasted, in the traditional procedure, the boreholes in it must be loaded with explosive charges and associated detonators. It will be appreciated that any reference herein to associated detonators includes locating them in or adjacent the explosive charges in the boreholes, wiring them in if they are not wireless, and ensuring they are in operative communication with an associated blasting machine.

A problem with clearing the fragmented rock in the bottom drive 102 beneath the ore portion 116 and loading the boreholes and associated detonators in the portion 116 is that the portion 116 is likely to have been damaged by the blast to create the fragmented material 112, leaving the portion 116 potentially as unsupported ground and therefore stranded ore even after the material 118 has been removed. This can make accessing the portion 116 to load the explosive charges and associated detonators risky and/or contrary to regulations. To overcome this, the portion 116 would have to be structurally supported and/or reinforced.

This difficulty is alleviated in accordance with the embodiment of the invention by loading the portion 116 with explosive charges and associated detonators initially, that is at the same time as the first portion of the body 100 to be blasted. As with the detonators in the first portion, the detonators in the portion 116 may be wired or wireless, but are advantageously wireless so as to alleviate risk of damage to their connection to the blasting machine(s) during the blasting of the first portion to create the fragmented material 112.

The bulk emulsion explosive in the explosives charges in the portion 116 should also be stable against desensitising as a result of the blast in the first portion, preferably requiring stable bulk emulsion explosives such as of the type previously mentioned. The emulsion explosives should also be sufficiently stable to not desensitise in the time period between the first stage blast and blasting the second portion 116. The delay may be merely for the time it takes to clear the fragmented material 118 in the bottom drive 102, including all or most of the fragmented material 112 as it continues to fall into the bottom drive 102 as new void is created in the bottom drive by the removal of the material 118.

Alternatively, the blasting of the portion 116 may be delayed longer for any technical, safety or commercial reason. During this time, no personnel access should be required beneath the portion 116. Likewise, the extraction of the fragmented material 118 should be performed remotely. It will be appreciated from the above that the blasting of the portion 116 is a separate and sequential user-controlled initiation event to the blasting of the first portion resulting in the fragmented material 112. All of the individual explosive charges in each of these portions may be initiated together, that is at the same time or in a staged manner, or groups of them may be initiated as discrete events.

The fragmented material from the portion 116 will fall into the void left by the fragmented material 112 from the first portion and into the bottom drive 102, and may be extracted remotely from the bottom drive 102 and the access drive.

Figure 6:
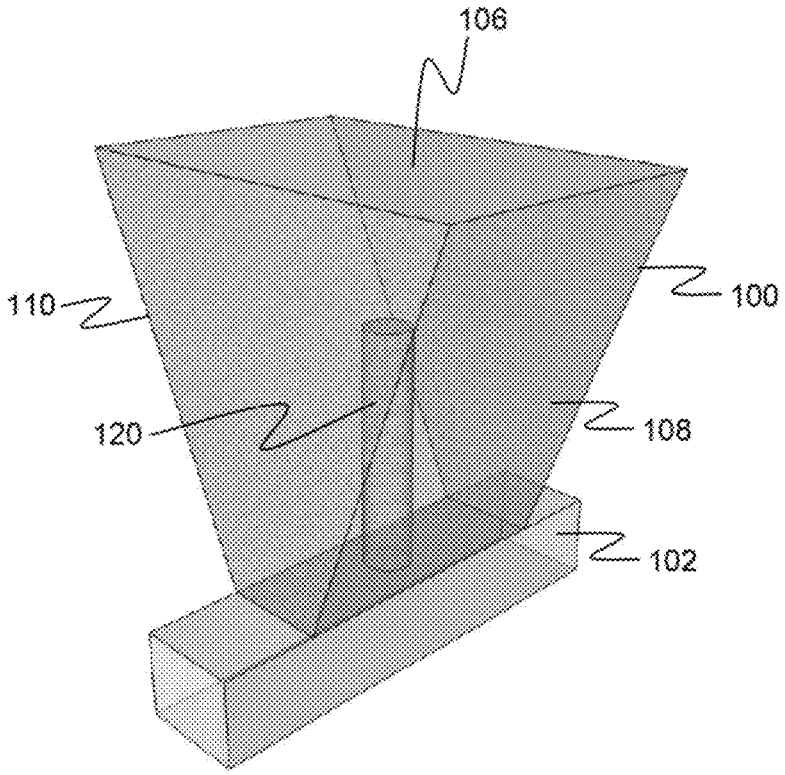
FIG. 6 is a schematic perspective view the first stage of another embodiment of a drawbell blast in accordance with the invention.
Figure 7:
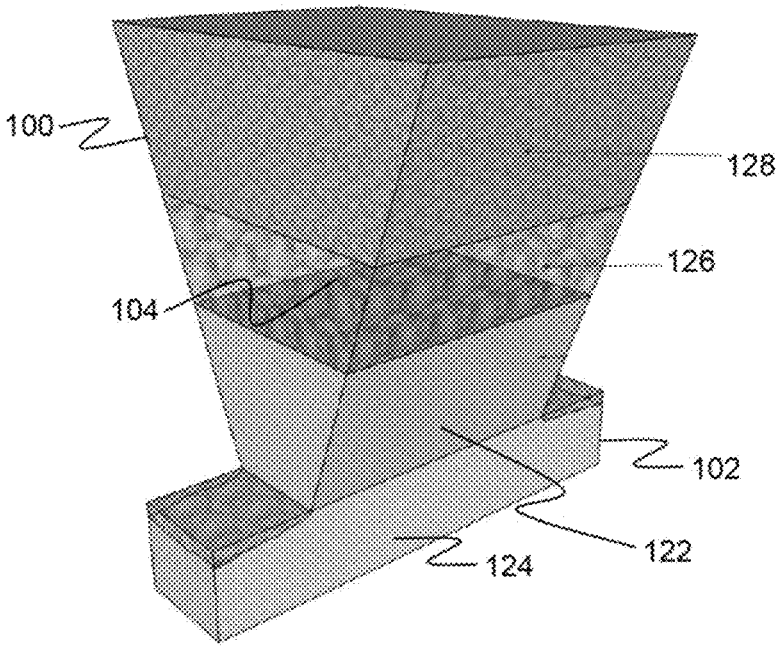
FIG. 7 is a view similar to FIG. 6, but showing the second stage of the blast.

Turning now to FIGS. 6 and 7, there is shown another variation of the traditional drawbell firing using an embodiment of the method of the invention. The drawbell, the bottom drive and the drilling of the boreholes as well as their loading with explosive charges and associated detonators is the same as in the method in accordance with the invention described with reference to FIGS. 4 and 5, so for convenience will not be described again. Furthermore, the same reference numerals have been used for the same parts.

The difference in FIGS. 6 and 7 over FIGS. 4 and 5 is that the sequential, user-controlled initiation events are separated horizontally rather than vertically. In this embodiment, therefore, the rise 120 is formed vertically in the centre of the body of ore 100, and only from the bottom drive 102 to about half way to the top face 106. This is achieved by not firing detonators in the upper portion of the borehole(s) around which the rise 120 is formed. Depending on ground conditions, the rise 120 might go to the full height of the drawbell 100, that is to the top face 106. Furthermore, the rise may be at any other location within the body of ore 100, and/or there may be more than one rise, provided the desired outcome can be achieved.

The desired outcome of the first of the sequential, discrete user-controlled initiation events is shown in FIG. 7. This is similar to FIG. 5, except that it is the lower portion of the body of ore 100 that is blasted first wholly around the rise 120 to achieve the fragmented ore 122. The fragmented ore is shown as having dropped into the bottom drive 102 at 124, leaving a void 126 above the fragmented material 122 and below the second stage, unblasted portion 128 of the body ore 100.

The upper, second portion 128 of the body of ore is stranded ore, in the sense that it may have been damaged during the blasting of the lower, first portion, it is unsupported ground, and access to it is blocked by the material 122 and 124. Some or all of that material may be removed by remote extraction prior to blasting the second portion 128, but this may not be necessary at all since that material when blasted can fall into the void 126.

If the fragmented material 122 and 124 from the first portion is removed first, the fragmented second portion 128 can fall directly into the bottom drive 102, at least in part for recovery by remote extraction. As in the embodiment of FIGS. 4 and 5, the first and second portions of the drawbell 100 can each be blasted at the same time or over a time period by a single initiation event or plural initiation events. However, preferably each is blasted in a single initiation event, with the two portions being blasted in two sequential discrete user-controlled initiation events.

This method could apply to multiple stoping methods, whereby vertical retreat through multiple discrete initiation events can take place without human access. It would also be possible to develop "blind", up hole long hole rises using the same methodology.

FIGS. 8 to 13 illustrate an embodiment of a method of blasting in accordance with the invention using stoping and backfilling. A common method of filling underground voids created by mining is to use fragmented rock or tailings fill with or without cement stabilisation. This fill material can become a source of ore dilution as portions of ore adjacent to the fill are extracted. This embodiment of the method of the invention allows a containment pillar of ore to be left in place to prevent dilution from the fill while the majority of the stope is blasted and mined in one or more discrete user-controlled initiation events. The containment pillar of ore is then blasted and mined in a subsequent discrete user-controlled initiation event.

Figure 8:
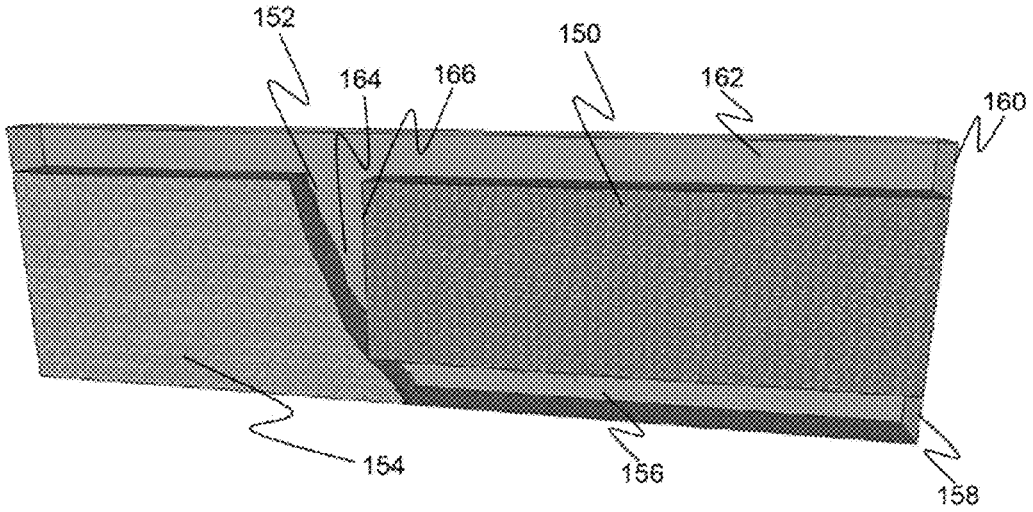
FIG. 8 is a schematic perspective view of a first stage of yet another embodiment of a method of blasting in accordance with the invention, retreat blasting and backfilling of the resultant stope.

Referring firstly to FIG. 8, an ore body 150 is shown as having been partially mined to leave an open stope 152 that has been filled with backfill 154. Traditionally, the ore body 150 is mined by a retreat mining, with the fragmented ore (from the left hand end of the ore body in the Figures) being extracted from a bottom drive 156 through an access drive 158 and the backfill being introduced to the open stope 152 by way of another access drive 160 (both access drives are illustrated schematically) and an upper drive 162.

In current practice, the blasting of the ore body 150 may be as described with reference to FIGS. 2*a* to 2*h* from one end of the ore body 30, for example as shown at the left hand end in FIGS. 2*g* and 2*h*, albeit with only the upper and lower drives 162 and 156. Thus, all of the boreholes in the ore body 150 may be drilled prior to blasting any of the ore body, but only those boreholes in the portion of the ore body to be blasted in a single discrete initiation event are loaded with explosive charges and associated detonators.

Figure 9:
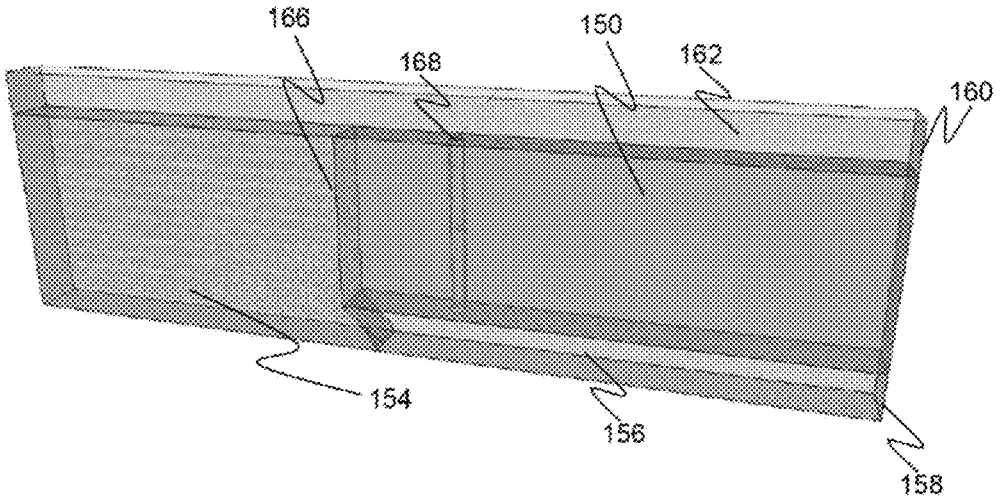
FIG. 9 is a view similar to FIG. 8, but showing the second stage of the blast.

Prior to each initiation event, the fragmented material from any previous initiation event is extracted via the bottom drive 156 and access drive 158 and the resultant void alongside the remaining ore body is filled with backfill, for example and for present purposes only, as illustrated in FIG. 9. It is then necessary to remove some of the backfill by way of the bottom drive 156 and access drive 158 in order to create a void into which newly blasted material can fragment, as illustrated at 164 in FIG. 8. However, the newly blasted material will then mix with the backfill, with the result that some of the fragmented ore is lost.

The embodiment in accordance with the invention is illustrated in FIGS. 9 to 13. In this embodiment, in FIG. 9 the backfill is illustrated as filling the open stope 152 and hard up against the adjacent end 166 of the ore body 150. As before, all of the boreholes may be drilled through the entire ore body from the bottom drive 156 to the upper drive 162 or adjacent to it (from the first blast in the ore body 150 resulting in the start of the open stope 152 or from the first blast to occur from the stage illustrated in FIG. 9). Likewise, in accordance with the invention, all of the boreholes may be loaded with explosive charges and associated detonators, preferably wireless detonators, or, less conveniently, only those boreholes in, for example, the left hand end of the ore body 150 illustrated in FIG. 9 may be loaded, in either case to perform two or more sequential, but not necessary consecutive, discrete user-controlled initiation events. As shown in FIG. 9, a rise 168 is formed through the ore body 150 from the bottom drive 156 to the top drive 162 at a distance spaced from the existing end face 166 sufficient to form a pillar 170 (see FIG. 10) to support the backfill and minimise contamination of the rest of the ore body when it is blasted. The rise 168 may be formed by blasting the explosive charges in one or more boreholes.

Figure 10:
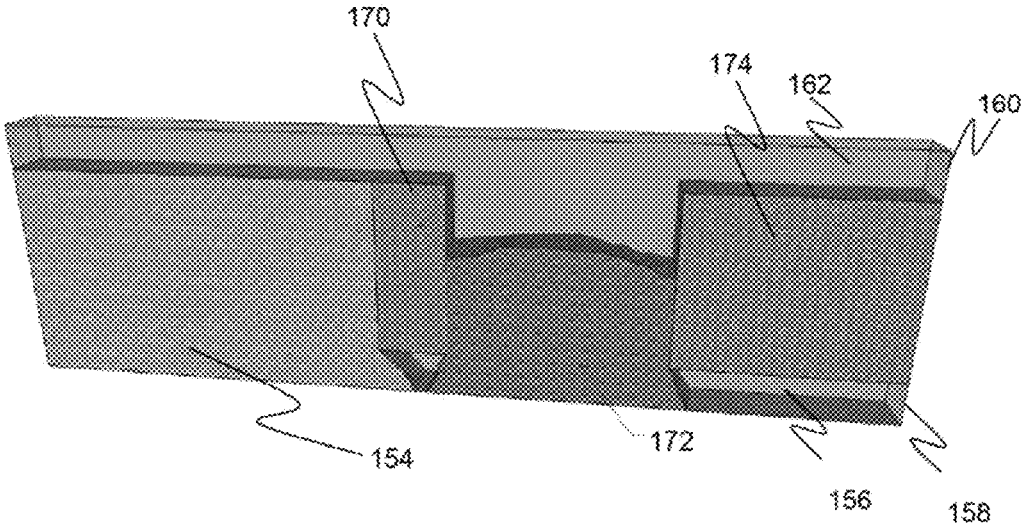
FIG. 10 is a view similar to FIG. 8, but showing the third stage of the blast.

Referring to FIG. 10, part of the ore body 150 to the side of the rise 168 remote from the end face 166, and part of the ore body on the same side as the end face 166 are blasted in one or more discrete user-controlled initiation events to fragment those parts of the ore body, as shown at 172 and leave the residual pillar 170.

As noted above, in addition to the boreholes in the pillar material 170, the boreholes blasted in this phase may be the only ones loaded with explosives material and associated detonators. Alternatively, the boreholes in the residual portion 174 of the ore body may also have been loaded with explosive charges and associated detonators to await one or more separate initiation events.

Figure 11:
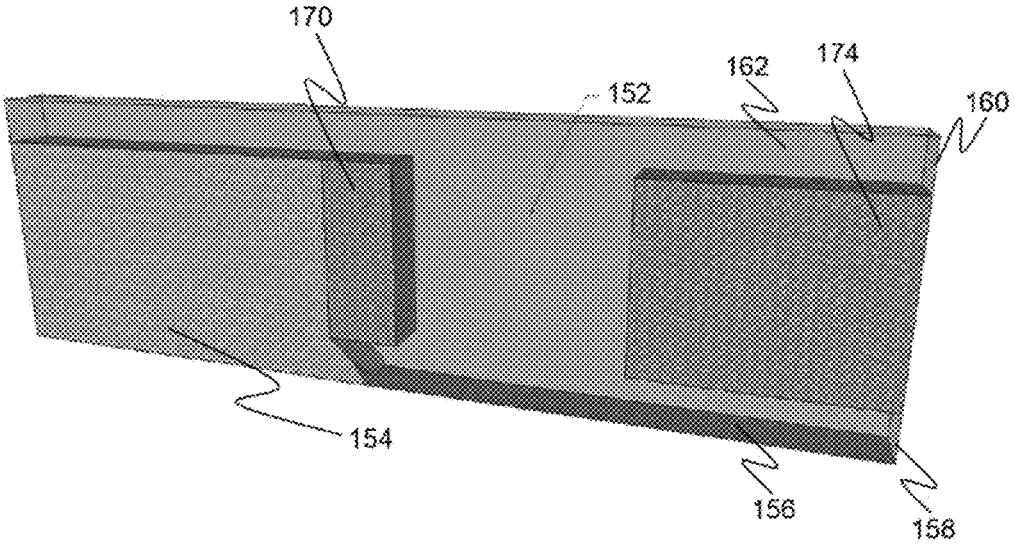
FIG. 11 is a view similar to FIG. 8, but showing the fourth stage of the blast.

In FIG. 11, the fragmented material 172 has been removed by means of a remote extractor (not shown) through the bottom drive 156 and associated access drive 158, leaving the pillar 170 of stranded ore supporting the backfill material 154, and therefore the extracted ore material 172 at least substantially free of contamination by the backfill material.

Figure 12:
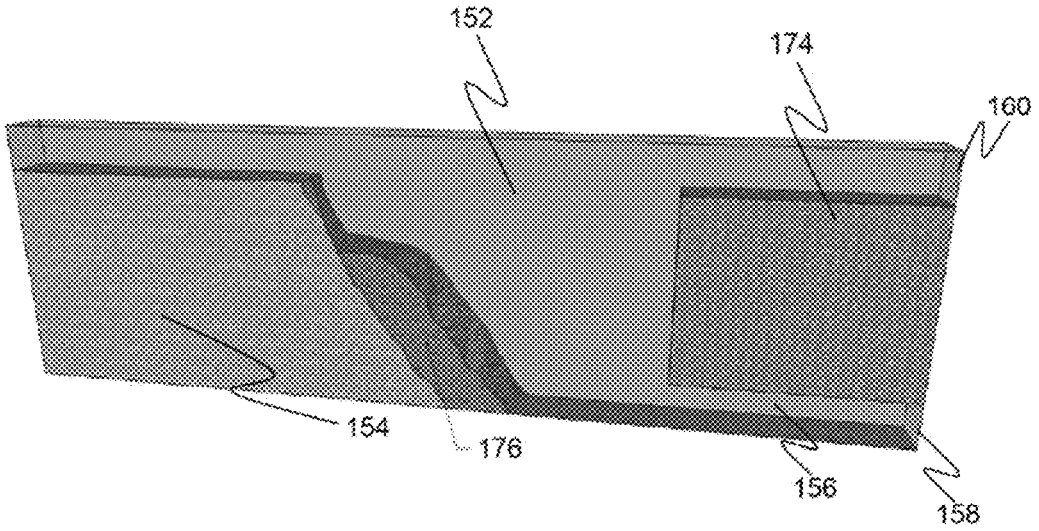
FIG. 12 is a view similar to FIG. 8, but showing the fifth stage of the blast.

In FIG. 12, the preloaded material of the pillar 170 is blasted without separate personnel access, to produce the fragmented pillar material 176. This is in contact with the backfill material 154, and will therefore be at least partly contaminated by the backfill material when it is extracted through the bottom drive 156. However, it has a much smaller volume than would have been the case for the fragmented ore body material 172 without the presence of the pillar 170.

Figure 13:
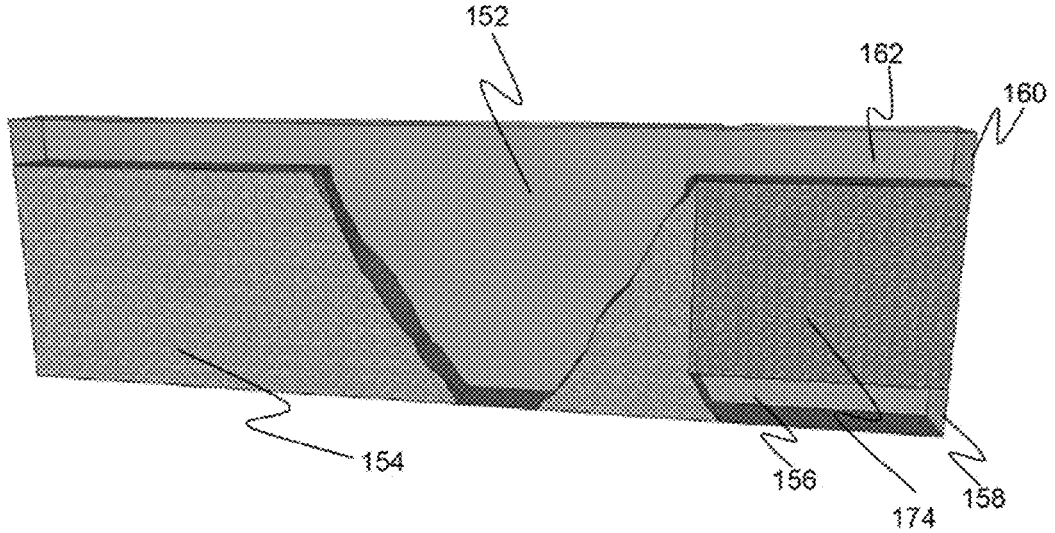
FIG. 13 is a view similar to FIG. 8, but showing the sixth stage of the blast.

After removal of the fragmented material 176, the residual ore body 174 could be blasted in a traditional retreat sequence, following loading with explosive charges and associated detonators if that has not already occurred. However, as shown in FIG. 13, the mined open stope 152 needs filling with backfill, and it is simplest to do this from the portion of the upper drive 162 above the residual ore body 174. Backfilling will continue until the open stope 152 is filled, that is until the new backfill material meets the existing backfill material 154. The sequence of forming a pillar and blasting the adjacent material and then the pillar may then be repeated.

Whilst the present invention has been described with reference to specific embodiments and specific methods for blasting, it will be appreciated that such embodiments and methods are merely exemplary, and other embodiments and methods other than those described herein, will be encompassed by the invention as defined by the appended claims. In particular, features of any one embodiment described above may be applied mutatis mutandis to any other embodiment, and this description should be read accordingly.

The reference in this specification to any prior publication (or information derived from it), or to any matter which is known, is not, and should not be taken as an acknowledgment or admission or any form of suggestion that that prior publication (or information derived from it) or known matter forms part of the common general knowledge in the field of endeavour to which this specification relates.

The invention claimed is:

1. A method of blasting rock at an underground blast site, the method comprising the steps of:

a) drilling boreholes in a rock mass;

b) loading each borehole with at least one charge of explosive material;

c) placing at least one detonator in operative association with each charge, each detonator being part of a discrete group of detonators and plural detonators placed in a single borehole being part of different groups;

d) conducting a sequence of at least two initiation events to blast the rock mass, each initiation event being a discrete user-controlled initiation event, in one of the at least two initiation events only the charges associated with a first group of detonators being initiated, by sending firing signals to only the first group of detonators and in a subsequent one of the at least two initiation events only the charges associated with a second group of detonators being initiated by sending firing signals to only the second group of detonators;

wherein the one initiation event creates a stranded portion of the rock mass that has been drilled and charged in steps a), b) and c) and said stranded portion of the rock mass is blasted in at least the subsequent initiation event without personnel accessing said stranded portion between the one and the subsequent initiation events.

2. The method of claim 1, wherein each detonator is an electronic detonator.

3. The method of claim 2, wherein each detonator forms part of a wireless detonator assembly for receiving and responding to wireless command signals, the step of conducting a sequence of at least two initiation events comprising transmitting at least two wireless command signals from one or more associated blasting machines to selectively FIRE the wireless detonator assemblies.

4. The method of claim 3, wherein each wireless detonator assembly is a wireless electronic booster.

5. The method of claim 1, wherein the detonators of the second group of detonators enter a sleep mode prior to their actuation.

6. The method of claim 1, wherein the explosive material comprises bulk emulsion explosive.

7. The method of claim 1, which further comprises extracting fragmented rock resulting from the one initiation event prior to the subsequent initiation event.

8. The method of claim 1, wherein the one initiation event leaves a pillar of rock that is blasted in the subsequent initiation event.

9. The method of claim 1, wherein the rock mass comprises a body of ore above a bottom drive and the boreholes are drilled in an upwards direction from the bottom drive into the body, and wherein the method further comprises forming at least one rise in the ore extending in a generally upward direction from the bottom drive whereby in said one initiation event material from the body of ore adjacent the rise is fragmented and falls into the rise and the bottom drive for extraction via the bottom drive, leaving a void, and whereby in the subsequent initiation event material of the body of ore is fragmented and falls at least partly into the void.

10. The method of claim 9, wherein in the subsequent initiation event portions of the body of ore adjacent the void and upper ends of the boreholes are fragmented, and optionally extracted via the bottom drive, prior to the last of the body of ore between said portions and the bottom drive being fragmented.

11. The method of claim 9, wherein said material of the body of ore fragmented in the one initiation event is to one side of the rise, in the longitudinal direction of the bottom drive, and said material of the body of ore fragmented in the subsequent initiation event is to the opposite side of the rise.

12. The method of claim 11, wherein the initiation events are repeated along the bottom drive.

13. The method of claim 9, wherein the portion of the body of ore fragmented in the subsequent initiation event is above the portion of the body of ore fragmented in the one initiation event.

14. The method of claim 9, wherein there is no drive above said bottom drive.

15. The method of claim 9, wherein each borehole extends at from 0 to 45 degrees to vertical.

16. The method of claim 9, wherein at least some of the boreholes are arranged in a ring of boreholes centred on the drive from which they are drilled for ring-firing of some of the detonators in accordance with pre-programmed delay times.

17. The method of claim 1, wherein the rock mass comprises a body of ore extending between a bottom drive and an upper drive, said bottom and upper drives each having a corresponding blind end, and the boreholes are drilled in a downwards direction from the upper drive into the body, and wherein the method further comprises forming at least one rise in the ore extending between the upper and bottom drives and remote from said blind end of the drives, optionally by actuating detonators and associated charges in at least one borehole, said one initiation event being adjacent the rise and the subsequent initiation event being performed in one or more portions of the body of ore between the rise and the blind end of the drives to fragment the material of said one or more portions such that the fragmented material can be extracted via the bottom drive.

18. The method of claim 17, wherein each borehole extends at from 0 to 45 degrees to vertical.

19. The method of claim 17, wherein at least some of the boreholes are arranged in a ring of boreholes centred on the drive from which they are drilled for ring-firing of some of the detonators in accordance with pre-programmed delay times.

20. The method of claim 1, wherein the rock mass comprises a body of ore extending between a bottom drive and an upper drive adjacent a stope formed between the bottom and upper drives at a remote end thereof and the boreholes are drilled in the body of ore from one of the drives towards the other drive, and wherein the method further comprises forming at least one rise in the ore between the bottom and upper drives and remote from said stope to form a portion of the body of ore between the stope and the rise, said one initiation event being in the body of ore adjacent said rise to leave a pillar formed from said portion of the body of ore, further one of the at least two initiation events being performed in the residual body of ore to the side of the location of the rise remote from the pillar, followed by extraction of fragmented material from the bottom drive, and the subsequent initiation event being performed to fragment the material of the pillar.

21. The method of claim 20, wherein the stope is at least partially filled with backfill material.

22. The method of claim 21, wherein backfill material is introduced from the upper drive to replace the fragmented and extracted material of the body of ore.

23. The method of claim 20, wherein each borehole extends at from 0 to 45 degrees to vertical.

24. The method of claim 20, wherein at least some of the boreholes are arranged in a ring of boreholes centred on the drive from which they are drilled for ring-firing of some of the detonators in accordance with pre-programmed delay times.

* * * * *